US009443710B2

(12) United States Patent
Platt et al.

(10) Patent No.: US 9,443,710 B2
(45) Date of Patent: Sep. 13, 2016

(54) TECHNIQUES FOR AUTOMATED PERFORMANCE MAINTENANCE TESTING AND REPORTING FOR ANALYTICAL INSTRUMENTS

(75) Inventors: Ian Thomas Platt, Lancs (GB); Timothy Charles Ruck, Congleton (GB); Almas Khan, Lancs (GB); Christopher John Porter, Warrington (GB)

(73) Assignee: Waters Technologies Corporation, Milford, MA (US)

( * ) Notice: Subject to any disclaimer, the term of this patent is extended or adjusted under 35 U.S.C. 154(b) by 0 days.

(21) Appl. No.: 14/236,373

(22) PCT Filed: Sep. 7, 2012

(86) PCT No.: PCT/US2012/054066

§ 371 (c)(1),
(2), (4) Date: May 6, 2014

(87) PCT Pub. No.: WO2013/039772

PCT Pub. Date: Mar. 21, 2013

(65) Prior Publication Data

US 2014/0239171 A1 Aug. 28, 2014

Related U.S. Application Data

(60) Provisional application No. 61/535,662, filed on Sep. 16, 2011.

(51) Int. Cl.

| | |
|---|---|
| ***H01J 49/00*** | (2006.01) |
| ***H01J 49/26*** | (2006.01) |
| ***H01J 49/02*** | (2006.01) |

(52) U.S. Cl.

CPC ..... *H01J 49/26* (2013.01); *H01J 49/02* (2013.01)

(58) Field of Classification Search

USPC ..... 250/282

See application file for complete search history.

(56) References Cited

U.S. PATENT DOCUMENTS 4,531,056 A 7/1985 Labowsky et al.
5,625,141 A 4/1997 Mahoney et al.

(Continued)

FOREIGN PATENT DOCUMENTS

WO WO 2007/089339 A2 8/2007

OTHER PUBLICATIONS

Christy Sarmiento Daniel, "Development and Application of Quality Standard Procedures (Operation, Verification and Maintenance) for an LC-MS System", University of Barcelona, Feb. 2010, pp. 1-80.*

(Continued)

*Primary Examiner* — Phillip A Johnston

(74) *Attorney, Agent, or Firm* — Muirhead and Saturnelli, LLC

(57) ABSTRACT

Techniques are described for performing performance maintenance on a mass spectrometer. Pre-maintenance testing is performed that automating execution of a test sequence in response to a first user interface selection. The maintenance activity performed upon completion of said pre-maintenance testing. Post-maintenance testing is preformed upon completion of said maintenance activity. The post-maintenance testing includes automating execution of the test sequence in response to a second user interface selection. A benchmark comparison is performed to determine whether performance of the mass spectrometer has degraded as a result of performing the maintenance activity, wherein said benchmark comparison is performed automatically in response to completing said post-maintenance testing.

20 Claims, 19 Drawing Sheets

(56) References Cited

U.S. PATENT DOCUMENTS

| | | | | |
|---|---|---|---|---|
| 7,853,435 | B2 * | 12/2010 | Dodge | B23K 9/0953 702/183 |
| 8,473,247 | B2 * | 6/2013 | Cruse | H01L 21/67276 702/176 |
| 2008/0201095 | A1 | 8/2008 | Yip et al. | |
| 2008/0234945 | A1 | 9/2008 | Walk et al. | |
| 2008/0244437 | A1 * | 10/2008 | Fischer | G06F 19/3406 715/772 |
| 2009/0032702 | A1 | 2/2009 | Quarmby et al. | |
| 2009/0194681 | A1 | 8/2009 | McCauley | |
| 2010/0042351 | A1 | 2/2010 | Covey et al. | |
| 2010/0301208 | A1 | 12/2010 | Powell | |

OTHER PUBLICATIONS

Daniel, "Development and Application of Quality Standard Procedures (Operation, Verification and Maintenance) for an LC-MS System," Erasmus Mundus, University of Barcelona, Feb. 2010, 76 pp.

Price et al. "Determination of Selected Pesticides and Flame Retardants in Drinking Water by Solid Phase Extraction and Capillary Column Gas Chromatography/Mass Spectrometry (GC/MS)," Apr. 2005, Revision 1.0, EPA Document #: 815-R-05-005, 43 pp.

Waters, "MassLynx MS Software," Apr. 26-29, 2010, 2 pp.

Dole, et al., "Molecular Beams of Macroions," AIP: The Journal of Chemical Physics, J. Chem. Phys. 49, 2240 (1968), 1 pp.

International Search Report dated Nov. 5, 2012.

International Preliminary Report on Patentability dated Apr. 4, 2013.

International Preliminary Report on Patentability for PCT/US2012/054066 dated Mar. 27, 2014.

Ed K. Price, et al., "Determination of selected pesticides and flame retardants in drinking water by solid phase extraction and capillar column gas chromotography/mass spectrometry (GC/MS)", EPA Document #: 815-R-05-005, Apr. 2005, Revision 1.0.

Waters, "Controlling Contamination in Ultraperformance LC/MS and HPLC/MS Systems", Revision D, (Mar. 3, 2008).

Daniel Christy Sarmiento, "Development and Application of Quality Standard Procedures(Operation, Verification and Maintenace) for an LC-MS System", Feb. 1, 2010.

European Search Report dated Jun. 12, 2015.

* cited by examiner

TABLE 1 - Part 1

| Class Name | Usage | Description |
|---|---|---|
| MLAcquireClass Class | Within individual test classes. | Responsible for interfacing with MassLynx to start and monitor the acquisition of mass spectral data. |
| MLDataClass Class | Within individual test classes. | Responsible for the processing of acquired data in general terms Contains methods for extracting MassLynx spectral and chromatographic data and manipulating the data to make a measurement |
| EPCUtilities Class | One instance created at the main thread level and referenced by individual tests. | Responsible for the low level control of the mass spectrometer including setting instrument parameters and obtaining instrument readings (voltages and pressures for example). |
| LogFileClass Class | Used in the WEAT Base class inherited by instrument base classes, an instance of which is created at the main thread level. Referenced by individual tests. | Responsible for recording results and comments in XML format during a testing process. |

FIG. 19A

TABLE 1 - Part 2

| Class Name | Usage | Description |
|---|---|---|
| HelpFileViewer<br>Class<br>→Form | Used in the WEAT Base class inherited by instrument base classes, an instance of which is created at the main thread level. Referenced by individual tests. | Responsible for the display of additional information in HTML format. This is a web browser as may be used internally by a software application . |
| WEATSecurity<br>Class | Used in the WEAT Base class inherited by instrument base classes, an instance of which is created at the main thread level. | Responsible for providing a monthly updating password to provide the secure aspect of the software. |
| StatusProvider<br>Abstract Class | Inherited by automation tests and utilities | Provides a range of properties that may be used to display status, results or information to a user interface |
| AutomationUtilit...<br>Class<br>→StatusProvider | Inherited by all individual automation utilities | Extends the status provider abstract class to provide logging functions using the LogFileClass. |
| AutomationTest<br>Class<br>→StatusProvider | Inherited by all individual automation tests. | Extends the utility to provide a results array and diagnostic extensions. |

FIG. 19B

TABLE 2

| Class Name | Usage | Description |
|---|---|---|
| TQBaseClass<br>Class<br>WEATBaseClass | One instance created at the main thread level and includes methods and public fields referenced by individual tests. The may be either directly implemented or implemented in a derived class. | Inherits from the WEAT base class to provide basic security, log file and browser support. There is always one instance of the WEATBaseClass derived class in an automation user interface to retain functions common to automation packages. |
| ResolutionTest<br>Class<br>AutomationTest | Example test, one instance (inheriting from the Automation test class) created at the main thread level. Methods of the ResolutionTest may be invoked as part of a workflow or as a standalone procedure. | Example test uses MLAcquire and MLData to acquire spectral data and measure the width of 5 spectral peaks across a defined mass range. The data is checked against width and linearity thresholds. |
| GainTest<br>Class<br>AutomationTest | Example test, one instance (inheriting from the Automation test class) created at the main thread level. Methods of GainTest may be invoked as part of a workflow or as a standalone procedure. | Example test uses MLAcquire and MLData to acquire spectral data and measure the intensity of 5 spectral peaks across a defined mass range. The data is checked against intensity thresholds. |
| CalFileChecker<br>Class<br>AutomationUtility | Example test, one instance (inheriting from the Automation utility class) created at the main thread level. Methods of CalFileChecker may be invoked as part of a workflow or as a standalone procedure. | Example utility identifies a list of calibration files associated with an instrument for information only. |

FIG. 20

TECHNIQUES FOR AUTOMATED PERFORMANCE MAINTENANCE TESTING AND REPORTING FOR ANALYTICAL INSTRUMENTS

This application is a National Stage of International Application No, PCT/US2012/054066, filed Sep. 7, 2012, which claims priority to U.S. Provisional Application No. 61/535,662, filed Sep. 16, 2011, all of which are incorporated by reference herein.

TECHNICAL FIELD

This application generally relates to techniques for use with analytical or scientific instruments and more particularly to automated performance testing and/or reporting in connection with analytical or scientific instruments.

BACKGROUND INFORMATION

Analytical or scientific instruments may be used in connection with sample analysis. Such instruments may include, for example, an instrument system that performs mass spectrometry, liquid chromatography, gas chromatography, and the like. In connection with such instruments, scheduled maintenance activities may be performed based on a predetermined time schedule. There may be scheduled maintenance of an instrument to proactively clean, replace, or perform other activities on instruments parts or components.

In connection with performing scheduled maintenance of an instrument, testing may be performed manually to ensure that the instrument's performance is acceptable after completion of the performed maintenance. Such manual testing may have drawbacks. Typically, a highly skilled and qualified technician is required to perform such maintenance and testing. Additionally, the manual testing may be inconsistently performed across serviced instruments thereby leading to inconsistent results regarding instrument performance after completion of the scheduled maintenance. Furthermore, performing the testing manually as well gathering and analyzing test results manually may be time consuming, cumbersome and error prone.

SUMMARY OF THE INVENTION

In accordance with one aspect of the invention is a method of performing performance maintenance on a mass spectrometer, the method comprising: performing pre-maintenance testing, wherein said pre-maintenance testing includes automating execution of a test sequence in response to a first user interface selection; performing a maintenance activity upon completion of said pre-maintenance testing; performing post-maintenance testing upon completion of said maintenance activity, wherein said post-maintenance testing includes automating execution of the test sequence in response to a second user interface selection; and performing a benchmark comparison to determine whether performance of the mass spectrometer has degraded as a result of performing the maintenance activity, wherein said benchmark comparison is performed automatically in response to completing said post-maintenance testing. Performing a benchmark comparison may include comparing pre-maintenance testing data and results to post-maintenance testing data and results. The test sequence may include any of an informational test, a non-critical threshold test and a critical threshold test. Failure of the non-critical threshold test may not cause termination of the test sequence thereby allowing execution of one or more tests of the test sequence subsequent to the failing non-critical threshold test. Responsive to a failure of a critical threshold test, the test sequence may terminate, a remedial action in accordance with the failed critical threshold test may be performed, and execution of the test sequence may resume with reperforming the failed critical threshold test. A first test that may be included in the test sequence and may be subsequent to the critical threshold test in the test sequence generates first test results and the first test may be dependent upon test results of the critical threshold test. Validity of the first test results may depend on having a successful test result of the critical threshold test. The test sequence may specify a predetermined order in which a plurality of tests are performed for the pre-maintenance testing and for the post-maintenance testing. The mass spectrometer may include one or more heaters which are tested in a first test of the test sequence. The first test may be a critical threshold test and wherein, responsive to a failure of the critical threshold test, the test sequence may terminates, a remedial action in accordance with the failed critical threshold test may be performed, and execution of the test sequence may resume with reperforming the failed critical threshold test. The test sequence may include a first test performing an intensity test. The first test may be a critical threshold test and wherein, responsive to a failure of the critical threshold test, the test sequence may terminate, a remedial action in accordance with the failed critical threshold test may be performed, and execution of the test sequence may resume with reperforming the failed critical threshold test. An electronic checklist may be displayed which lists a plurality of items completed in connection with performing the maintenance activity and, responsive to user interface selections indicating completion of the plurality of items, a first user interface item selected in connection with the first user interface selection may be disabled and a second user interface item selected in connection with the second user interface selection may be enabled. Responsive to the benchmark comparison determining that performance of the mass spectrometer has degraded as a result of performing the maintenance activity, said post-maintenance testing may be re-performed a subsequent time and the benchmark comparison may be re-performed using first test data and results from the pre-maintenance testing and second test data and results from re-performing the post-maintenance testing. The method may also include saving performance maintenance status information characterizing a current state of performance maintenance processing. The status information may be used to enable resuming execution of performance maintenance processing at a subsequent point in time, said performance maintenance processing including said steps of performing pre-maintenance testing, performing a maintenance activity, performing post-maintenance testing, and performing a benchmark comparison. The method may aso include determining an overall status of the performance maintenance. The step of determining the overall status may include: performing said benchmark comparison and determining a first status indicating whether performance of the mass spectrometer has degraded as a result of performing the maintenance activity, said first status being success if the performance has not degraded; obtaining a testing outcome of pass or fail from each of one or more other tests; and performing a logical AND operation of the first status and the testing outcome for each of the one or more other tests thereby determining said overall status is success only if the first status indicates success and the testing outcome for each of the one or more other tests indicates success, otherwise said overall status is failure.

The one or more other tests may include a first non-critical threshold test performed as part of both said pre-maintenance testing and said post-maintenance testing and a second test performed in said post-maintenance testing and not in said pre-maintenance testing. The step of performing said benchmark comparison may include comparing first performance results for the first non-critical threshold test executed in said pre-maintenance testing with second performance results for the first non-critical threshold test executed in said post-maintenance testing. The step of performing said benchmark comparison may include comparing a first value for a metric included in the first performance results to a second value for the metric in the second performance results.

In accordance with another aspect of the invention is a computer readable medium comprising executable code stored thereon for performing performance maintenance on a mass spectrometer, the computer readable medium comprising code for: performing pre-maintenance testing, wherein said pre-maintenance testing includes automating execution of a test sequence in response to a first user interface selection; performing a maintenance activity upon completion of said pre-maintenance testing; performing post-maintenance testing upon completion of said maintenance activity, wherein said post-maintenance testing includes automating execution of the test sequence in response to a second user interface selection; and performing a benchmark comparison to determine whether performance of the mass spectrometer has degraded as a result of performing the maintenance activity, wherein said benchmark comparison is performed automatically in response to completing said post-maintenance testing. The code that performs the benchmark comparison may include comparing pre-maintenance testing data and results to post-maintenance testing data and results. The test sequence may include any of an informational test, a non-critical threshold test and a critical threshold test.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the techniques described herein.

FIGS. 19A and 19B are an example of a table, TABLE 1, of classes that may be used in an embodiment in accordance with techniques herein; and FIG. 20 is an example of a table, TABLE 2, of classes in the instrument level derived class library that may be used in an embodiment in accordance with techniques herein.

DESCRIPTION

As used herein, the following terms generally refer to the indicated meanings:

"Chromatography"—refers to equipment and/or methods used in the separation of chemical compounds. Chromatographic equipment typically moves fluids and/or ions under pressure and/or electrical and/or magnetic forces. The word "chromatogram," depending on context, herein refers to data or a representation of data derived by chromatographic means. A chromatogram can include a set of data points, each of which is composed of two or more values; one of these values is often a chromatographic retention time value, and the remaining value(s) are typically associated with values of intensity or magnitude, which in turn correspond to quantities or concentrations of components of a sample.

Retention time—in context, typically refers to the point in a chromatographic profile at which an entity reaches its maximum intensity.

Ions—A compound, for example, that is typically detected using a mass spectrometer (MS) appears in the form of ions in data generated as a result of performing an experiment such as with an MS in combination with a liquid chromatography (LC) system (e.g., LC/MS) or a gas chromatography (GC) system (e.g., GC/MS). An ion has, for example, a retention time and an m/z value. The LC/MS or GC/MS system may be used to perform experiments and produce a variety of observed measurements for every detected ion. This includes: the mass-to-charge ratio (m/z), mass (m), the retention time, and the signal intensity of the ion, such as a number of ions counted.

A mass chromatogram may refer to a chromatogram where the x-axis is a time-based value, such as retention time, and the y-axis represents signal intensity such as of one or more ion masses.

A mass spectrum or spectrum may refer to a mass spectral plot such as of a single scan time of ion intensity vs. mass or m/z.

Generally, an LC/MS or GC/MS system may be used to perform sample analysis and may provide an empirical description of, for example, a protein or peptide as well as a small molecule in terms of its mass, charge, retention time, and total intensity. When a molecule elutes from a chromatographic column, it elutes over a specific retention time period and reaches its maximum signal at a single retention time. After ionization and (possible) fragmentation, the compound appears as a related set of ions. In an LC/MS separation, a molecule may produce a single or multiple charged states. MS/MS may also be referred to as tandem mass spectrometry which can be performed in combination with LC separation (e.g., denoted LC/MS/MS).

Figure 1:
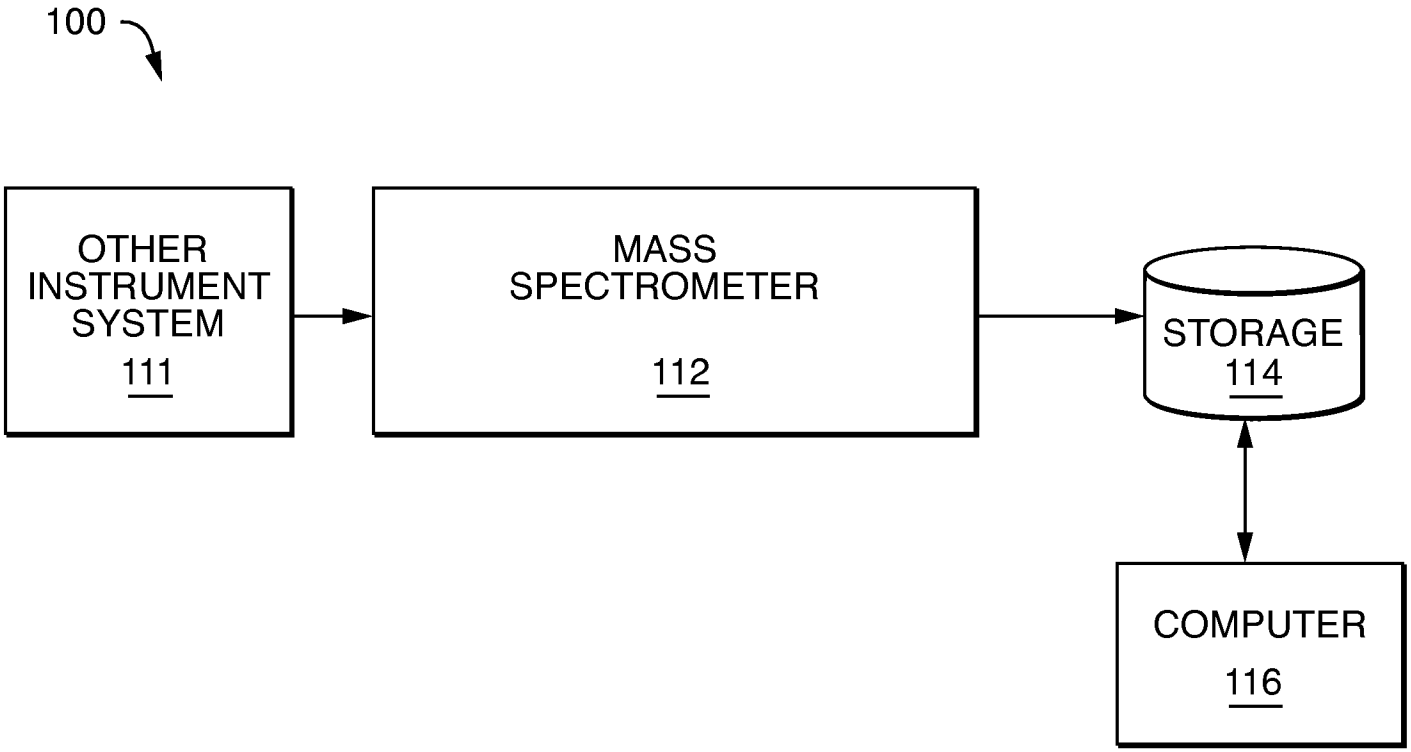
FIG. 1 is a block diagram of a system, in accordance with one embodiment of the techniques herein.

Referring to FIG. 1, shown is an embodiment of a system in accordance with techniques herein. The system 100 may include a mass spectrometer (MS) 112, other instrument system 111, storage 114 and a computer 116. The other instrument system 111 may be, for example, an LC or GC system, which interfaces with the MS 112 in connection with sample analysis. As known to those of ordinary skill in the art, the system 100 may be used to perform analysis of a sample for detection, identification and/or quantification of one or more compounds of interest. A chromatographic separation technique, such as by an LC, may be performed prior to injecting the sample into the MS 112. Chromatography is a technique for separating compounds, such as those held in solution, where the compounds will exhibit different affinity for a separation medium in contact with the solution. As the solution flows through such an immobile medium, the compounds separate from one another. As noted above, common chromatographic separation instruments that may serve as the other instrument system 111 include a GC or LC system which, when coupled to a mass spectrometer, may be referred to respectively as GC/MS or LC/MS systems. GC/MS or LC/MS systems are typically on-line systems in which the output of the GC or LC 111 is coupled directly to the MS 112 for further analysis.

During analysis by the MS 112, molecules from the sample are ionized to form ions. A detector of the MS 112 produces a signal relating to the mass of the molecule and charge carried on the molecule and a mass-to-charge ratio (m/z) for each of the ions is determined. Although not illustrated in FIG. 1, the MS 112 may include components such as a desolvation/ionization device, collision cell, mass analyzer, detector, and the like. In an LC/MS system, a sample is injected into the liquid chromatograph at a particular time. The liquid chromatograph causes the sample to elute over time resulting in an eluent that exits the liquid chromatograph. The eluent exiting the liquid chromatograph is continuously introduced into the ionization source of the MS 112. As the separation progresses, the composition of the mass spectrum generated by the MS evolves and reflects the changing composition of the eluent. Typically, at regularly spaced time intervals, a computer-based system samples and records the spectrum. The response (or intensity) of an ion is the height or area of the peak as may be seen in the spectrum. The spectra generated by conventional LC/MS systems may be further analyzed. Mass or mass-to-charge ratio estimates for an ion are derived through examination of a spectrum that contains the ion. Retention time estimates for an ion are derived by examination of a chromatogram that contains the ion.

Two stages of mass analysis (MS/MS also referred to as tandem mass spectrometry) may also be performed. For example, one particular mode of MS/MS is known as product ion scanning where parent or precursor ions of a particular m/z value are selected in the first stage of mass analysis by a first mass filter/analyzer. The selected precursor ions are then passed to a collision cell where they are fragmented to produce product or fragment ions. The product or fragment ions are then mass analyzed by a second mass filter/analyzer.

Mass analyzers of the MS 112 can be placed in tandem in a variety of configurations, including, e.g., quadrupole mass analyzers. A tandem configuration enables on-line collision modification and analysis of an already mass-analyzed molecule. For example, in triple quadrupole based massed analyzers (such as Q1-Q2-Q3), the second quadrupole (Q2) imports accelerating voltages to the ions separated by the first quadrupole (Q1). These ions collide with a gas expressly introduced into Q2. The ions fragment as a result of these collisions. Those fragments are further analyzed by the third quadrupole (Q3). For example, the Xevo™ TQ Mass Spectrometer and the Xevo™ TQ-S Mass Spectrometer, both by Waters Corporation of Milford Mass., are examples of triple quadrupole mass spectrometers.

As an output, the MS 112 generates a series of spectra or scans collected over time. A mass-to-charge spectrum or mass spectrum is ion intensity plotted as a function of m/z or mass. Each element, a single mass or single mass-to-charge ratio, of a spectrum may be referred to as a channel. Viewing a single channel over time provides a chromatogram for the corresponding mass or mass-to-charge ratio. The generated mass-to-charge spectra or scans can be acquired and recorded on a storage medium such as a hard-disk drive or other storage media represented by element 114 that is accessible to computer 118. Typically, a spectrum or chromatogram is recorded as an array of values and stored on storage 114. The spectra stored on 114 may be accessed using the computer 116 such as for display, subsequent analysis, and the like. A control means (not shown) provides control signals for the various power supplies (not shown) which respectively provide the necessary operating potentials for the components of the system 100 such as the MS 112. These control signals determine the operating parameters of the instrument. The control means is typically controlled by signals from a computer or processor, such as the computer 116.

A molecular species migrates through column 110 and emerges, or elutes, from column 110 at a characteristic time. This characteristic time commonly is referred to as the molecule's retention time. Once the molecule elutes from column 106, it can be conveyed to the MS 112. A retention time is a characteristic time. That is, a molecule that elutes from a column at retention time t in reality elutes over a period of time that is essentially centered at time t. The elution profile over the time period is referred to as a chromatographic peak. The elution profile of a chromatographic peak can be described by a bell-shaped curve. The peak's bell shape has a width that typically is described by its full width at half height, or half-maximum (FWHM). The molecule's retention time is the time of the apex of the peak's elution profile. Spectral peaks appearing in spectra generated by mass spectrometers have a similar shape and can be characterized in a similar manner.

The storage 114 may be any one or more different types of computer storage media and/or devices. As will be appreciated by those skilled in the art, the storage 114 may be any type of computer-readable medium having any one of a variety of different forms including volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, (DVD) or other optical storage, magnetic cassettes, magnetic tape, magnetic disk storage or other magnetic storage devices, or any other medium which can be used to store the desired code, data, and the like, which can accessed by a computer processor.

The computer 116 may be any commercially available or proprietary computer system, processor board, ASIC (application specific integrated circuit), or other component which includes a computer processor configured to execute code stored on a computer readable medium. The processor, when executing the code, may cause the computer system 116 to perform processing steps such as to access and analyze the data stored on storage 114. The computer system, processor board, and the like, may be more generally referred to as a computing device. The computing device may also include, or otherwise be configured to access, a computer readable medium, such as represented by 114, comprising executable code stored thereon which cause a computer processor to perform processing steps.

In connection with analytical or scientific instruments such as the MS 112 of FIG. 1, performance maintenance (PM) may be performed. Although PM in connection with an MS will be described, it will be appreciated by those of ordinary skill in the art that techniques described herein may be used, more generally, in connection with other systems, instruments and devices. PM for an MS may refer to performing a maintenance activity on the MS such as in accordance with a predetermined time-based schedule to ensure proper instrument performance. PM may include, for example, cleaning or replacing a part or another mechanical activity with respect to the MS. The PM process typically includes performing PM testing to ensure proper MS performance after performing the maintenance activity. The PM process which includes testing and performing the maintenance activity may be generally characterized as including three stages. In a first stage of the PM process, the system performance is benchmarked prior to performing any maintenance activity. The first stage may include performing one or more tests and storing the test results and may also be referred to as pre-maintenance testing. In a second stage, the maintenance activity (e.g., such as for performing mechanical system maintenance) is then performed. In a final third stage after performing the maintenance activity, the system performance is again benchmarked such as by repeating the tests performed the first stage, alone or in combination with, possible additional tests. The third stage may also be referred to as post-maintenance testing. Comparison of test results before and after performing the maintenance activity may be used to determine whether the instrument performance has been maintained or improved as a result of performing the maintenance activity. Information describing the particular maintenance activity performed and the results of the comparison of benchmarking tests may be included in a report for presentation to a user. The performance of the system may be expected to be the same or otherwise improved after performing the maintenance activity as compared to system performance prior to performing the maintenance activity.

The tests performed in connection with benchmarking MS system performance before and after performing the maintenance activity may include, for example, changing instrument settings, monitoring instrument readings, collecting system information, acquiring and processing mass spectrometer data in defining system performance.

Described in following paragraphs are techniques that may be used to automate the PM process in connection with a MS. In one embodiment as described in more detail below, techniques may be embodied in a software tool or application that interfaces with the MS and its control system, for example, to automate performing the benchmark tests of pre-maintenance and post-maintenance testing, set instrument values, observe and record instrument readings and system information, and acquire and process the system performance data. The use of such automated techniques provide for an orderly well-defined process for the PM process including the three stages as described above.

Tests and associated test data captured and analyzed during the performance maintenance benchmarking may be generally partitioned into three categories. A first category of tests and test data collected may be referred to as informational or information only. For example, informational test data may include information about installed software such as a version of a library, operating system, instrument driver, and the like. A second category of tests and test data may be referred to as non-critical threshold tests and test data. With the non-critical threshold category, the test data collected may be used in connection with comparison to a first performance threshold indicating a level of acceptable performance. For example, an observed metric obtained from collecting and/or analyzing test data may fall below a defined threshold indicating an acceptable performance level. In this case, the individual test that generated the test data may have an associated failure state and may otherwise have an associated pass or success state. A third category of tests and test data may be referred to as critical threshold tests and test data. With the critical threshold category, test data collected may be used in connection with comparison to a second performance threshold indicating a critical performance threshold. For example, an observed metric obtained from collecting and/or analyzing test data may fall below a defined critical threshold. In this case, the individual test that generated the test data may have an associated failure state and may otherwise have an associated pass or success state. However, since the threshold is defined as a critical threshold and the test has failed, an additional remedial action outside the scope of (or in addition to) the PM activity is needed. Additionally, in connection with the failed critical threshold test, the entire pre-maintenance or post-maintenance testing process comprising multiple tests may be terminated until the one or more remedial actions are completed.

Pre-maintenance and post-maintenance tests performed may include a defined testing sequence of one or more individual tests, where test data may be collected from each such test. An individual test and its associated test data may fall into one of the foregoing categories. A same set of tests may be performed as part of the testing sequence for both pre and post maintenance testing. Additionally, after completion of the pre-maintenance and post-maintenance testing, a relative performance comparison may be made between test data sets of pre-maintenance testing and post-maintenance testing for all such tests performed in both pre- and post-maintenance testing. Such a relative comparison may be used to determine if the PM activity has caused the system performance to degrade relative to system performance prior to performing the PM activity.

In connection with the automated processing of an embodiment in accordance with techniques herein, each of the required tests of the test sequence (for pre and post maintenance) are performed in a defined order appropriate to the operation of the mass spectrometer. Where critical threshold data does not pass the required performance level, the testing is terminated to allow remedial actions to be performed. The benchmark test results of both pre and post-maintenance testing may be displayed to the user in a format appropriate to the data being presented, for example, with an icon graphically representing success for non-critical threshold and critical threshold tests.

As will be described below in more detail, in one embodiment described herein the user interacts with the software application to start the pre-maintenance testing. Once the pre-maintenance testing is complete, a software checklist of maintenance activity is enabled and displayed to a user enumerating various steps of the maintenance activity/ies comprising the second stage of the PM process. When all mandatory maintenance activity has been confirmed as having been performed, the post-maintenance testing function of the application is enabled and may be initiated by the user, such as via user interface (UI) selection. When post-maintenance testing is completed, an automatic comparison of benchmark test results, from before and after the maintenance, is performed in order to indicate the overall success of the maintenance and associated PM process. When the post maintenance testing is successful, a report of the test results, comparison and maintenance activities performed may be generated. In connection with one aspect of the foregoing, the UI may be viewed as controlling the overall process flow of the PM process by enabling the relevant functions in the software application at the appropriate time. The current state of the PM process may be saved and recalled by the software application so that, for example, a user may perform only pre-maintenance testing and continue with the remainder of the PM process at a later point in time, a user may perform pre-maintenance testing having a failed critical threshold test. The user may resume testing at a later point in time after an appropriate remedial action has been performed.

Each particular MS instrument system characterized by particular attributes may have its own customized set of tests as used in connection with pre and post maintenance testing. For example, the customized set of tests may vary with whether the instrument category is an MS or LC system. Furthermore, the customized set of tests comprising the test sequence, as well as particular thresholds, settings and other parameters used in connection with such tests, may vary with the particular attributes of each general instrument category or subcategories of MS instruments. For example, the tests may vary with whether the MS instrument is a quadrupole or time of flight (TOF) MS system. Furthermore, the tests may vary with the particular model and vendor of the quadrupole. For example, a first test sequence may be used with a first MS system such as the Xevo™ TQ Mass Spectrometer and a second different test sequence may be used with a second MS system such as the Xevo™ TQ-S Mass Spectrometer.

What will now be described are UI displays or screenshots of an application performing PM processing in accordance with techniques herein. In connection with the example illustrated below, PM processing is described as may be used in connection with the Xevo™ TQ Mass Spectrometer.

Figure 2:
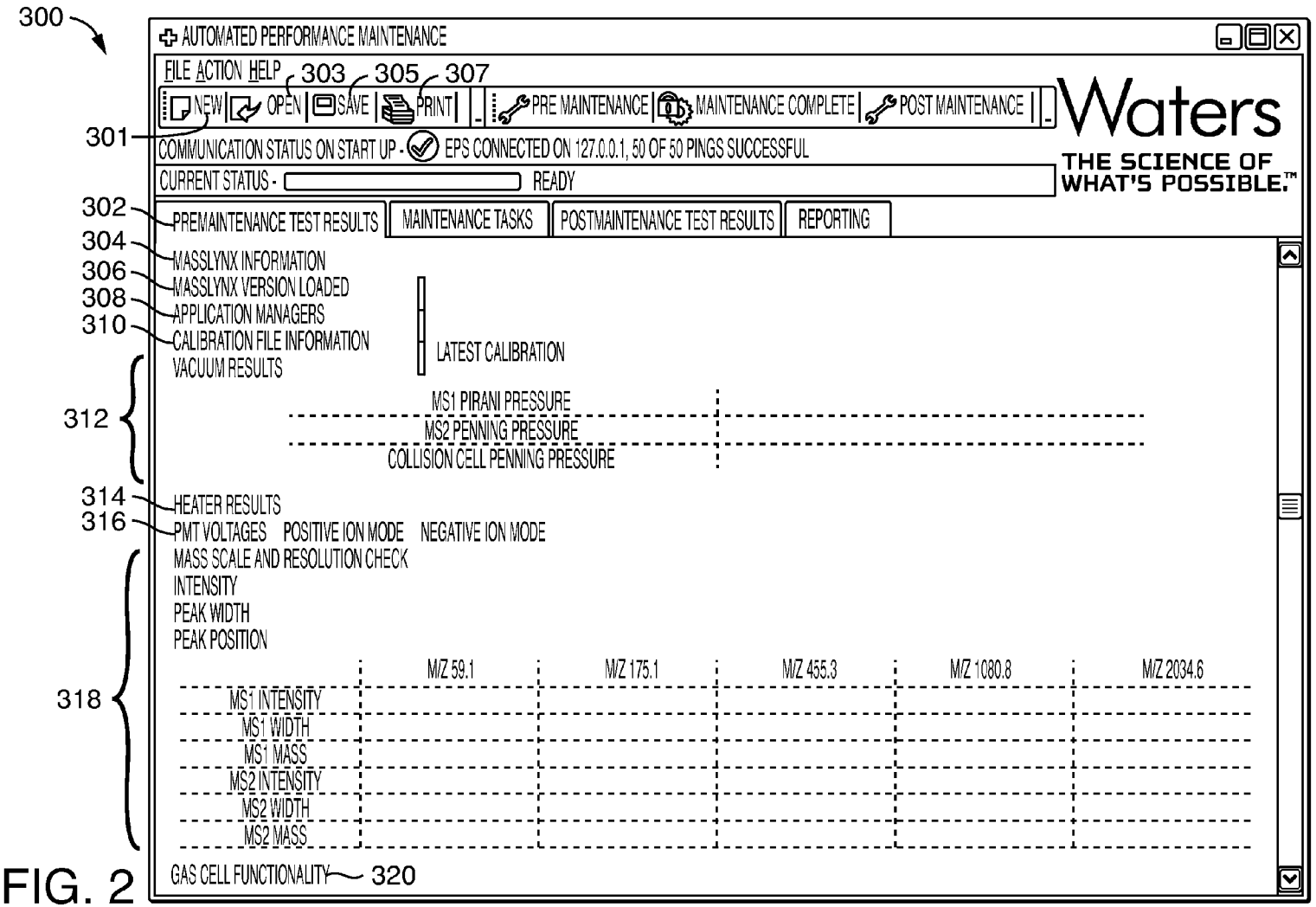
FIGS. 2-8 are examples of screenshots illustrating information as may be displayed in connection with a user interface in an embodiment in accordance with techniques herein.

Referring to FIG. 2, shown is an example of a UI display of an application performing automated PM in accordance with techniques herein. The example 300 may displayed on first launching the application prior to performing any PM processing steps. The example 300 generally displays an incomplete template including fields for of pre-maintenance MS test data as indicated by tab 302. The pre-maintenance testing, when complete, will result in providing data for display in accordance with the fields of 300. In connection with this example, pre-maintenance testing may include performing a test sequence of multiple tests such as, for example to obtain data on software used in connection with populating fields 304, 306, and 308 (e.g., software libraries and versions installed on the computer system, used to communicate with the MS system, and the like), obtain calibration file information for populating 310, obtain pressure-related data values or readings used in connection with 312, test a heater and display results in 314, obtain voltage information or readings in connection with 316, perform test(s) for mass scale and resolution checking of the MS system in connection with 318, and perform test(s) related to gas cell functionality in connection with 320. The foregoing and related tests are described in more detail elsewhere herein.

Figure 3:
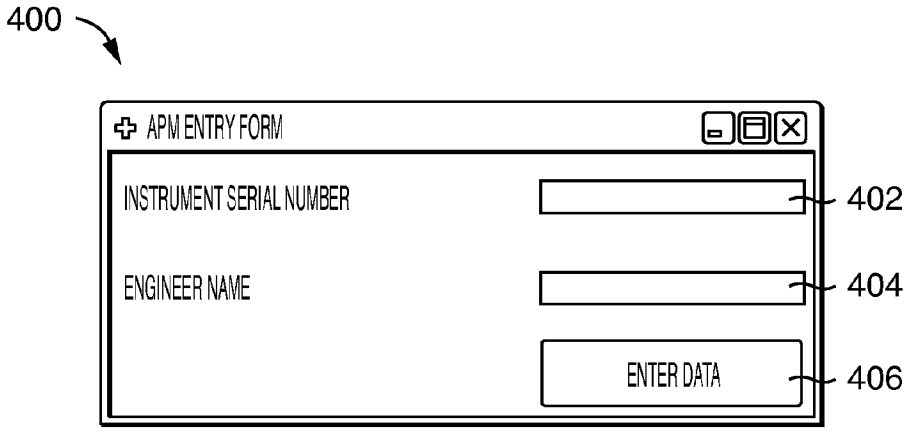
Figure 4:
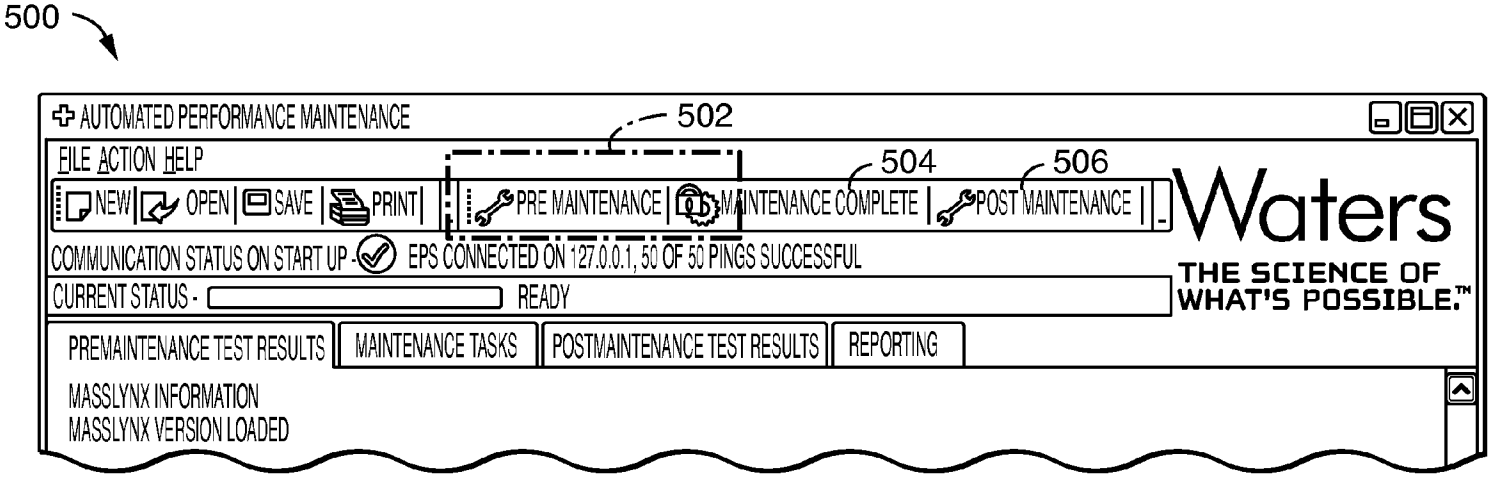

The user may then select new 301 and receive the dialogue box of FIG. 3. As illustrated in the example 400 of FIG. 3, the user may then enter an instrument serial number 402 and user name or identifier 404. The serial number entered into 402 may uniquely identify the particular MS instrument system thereby enabling tracking and identification of information such as related to testing and PM activity for the particular MS system. The name or identifier entered into 404 may be a user identifier identifying a user of the application. Data of 404 may be used as part of authentication of a valid user of the application or system performing the PM process and testing. An embodiment may require other information than as illustrated in FIG. 3 prior to allowing the user to continue performing processing. Upon completion of data entry into 402 and 404, the user may select 406 causing the application to verify the entered data. If the data entered into 402 and 404 is valid, the application may then enable certain UI options thereby allowing the user to proceed to the next step or stage in the PM process in connection with pre-maintenance testing. For example, FIG. 4 illustrates that the PreMaintenance option 502 may be enabled. It should be noted that the PreMaintenance option in example 300 of FIG. 3 is greyed out indicating that such option is not enabled. In comparison to FIG. 4, the Pre-Maintenance option 502 is indicated as enabled by a visual change to the displayed option. Note however that other options associated with maintenance complete 504 and post maintenance 506 remain disabled as may be indicated by their visual display. Portions of the PM processing associated with 504 and 506 are not enabled at this point in the PM process so that a user cannot perform the processing associated with such steps. Thus, the UI provides a measure of control in connection with requiring and enforcing steps of PM process to be performed in a particular predefined order.

It should be noted that if the user selected the open option 303 rather than new 301, the user may be prompted for information as illustrated in connection with FIG. 3. However, in response to entering the data of FIG. 3, an open file dialogue box may be displayed to open previously saved files of data in connection with previously performed PM processing sessions. For example, the list of files from which a user may select to open may include data for a previously completed PM process where all pre and post maintenance testing and benchmark testing have been completed. The list of files may include, for example, a file for a previously started but incomplete PM process such as where a critical threshold test failed. Using the open option, the user may now select to continue or resume the PM process and testing such as from the point in the testing sequence beginning with the failed critical threshold test.

In connection with PM processing described above with selection of the open option 303 of FIG. 2, when a file is selected, the program restores all the saved data, sets or restores the current PM testing state to be in accordance with the selected PM testing file, activates/deactivates the relevant menu and toolbar items, and the like, based on the current testing state. The displayed menu bar may also include a save option 305 that may be activate/deactivated at appropriate times during the PM testing. Selecting a save option when enabled (e.g., see element 601 of FIG. 6 for example), writes the current collected data and PM state to a file with the serial number of the instrument (as entered by the user) and the current date formulated to a file name. Selecting the print option (e.g., see element 307) when enabled opens a print dialogue to choose a printer enabling a printout of the final report.

With reference back to FIG. 4, at this point, the user may select 502 to commence performing pre-maintenance testing. As described in more detail elsewhere herein, each test of the pre-maintenance testing may be characterized as informational other than any critical threshold test(s). After completion of the pre-maintenance tests included in the pre-maintenance test sequence, or until failure of a critical threshold test thereby causing termination of the test sequence, pre-maintenance testing results may be displayed to the user via the UI as illustrated in the example 600 of FIG. 5.

Figure 5:
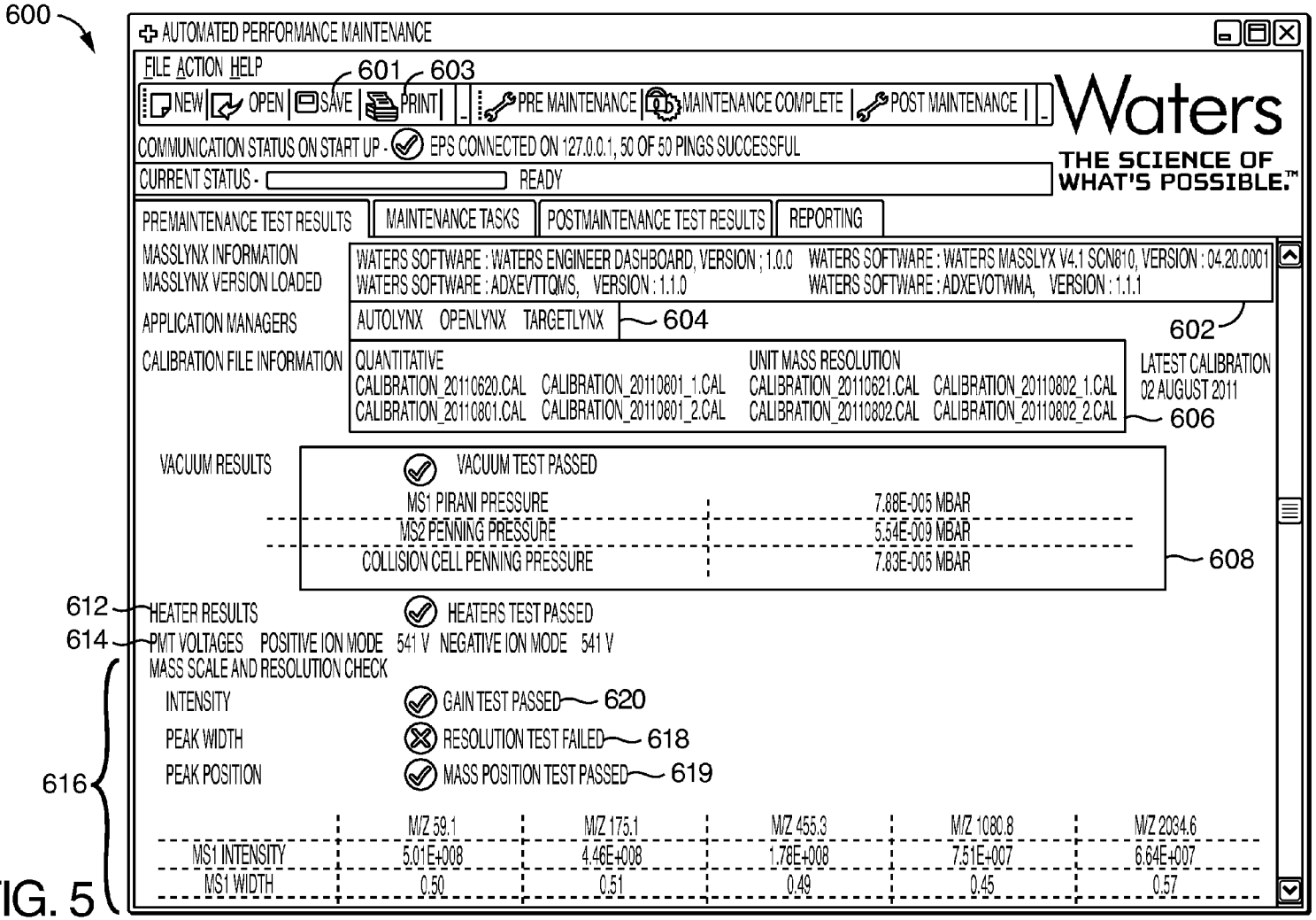

Information displayed in connection with the example 600 of FIG. 5 is described in more detail below in connection with the tests performed. At this point, it should be noted that the workflow PM process has completed premaintenance testing with a resolution test failure as indicated by 618. However, as described in more detail elsewhere herein, such a test may not be a critical threshold test but may rather be a non-critical threshold test so subsequent tests of the pre-maintenance testing sequence may complete despite failure indicated in 618. If the test is a non-critical threshold test, an embodiment may output the resulting status of the test (e.g., pass, fail, or other possible result state) and proceed to perform the next test in the sequence even in response to a failure. In other words, failure of a non-critical threshold test may not alter the testing sequence thereby, upon completion of a non-critical threshold test (regardless of resulting testing status), processing in the test sequence continues with the next test in the sequence.

Figure 6:
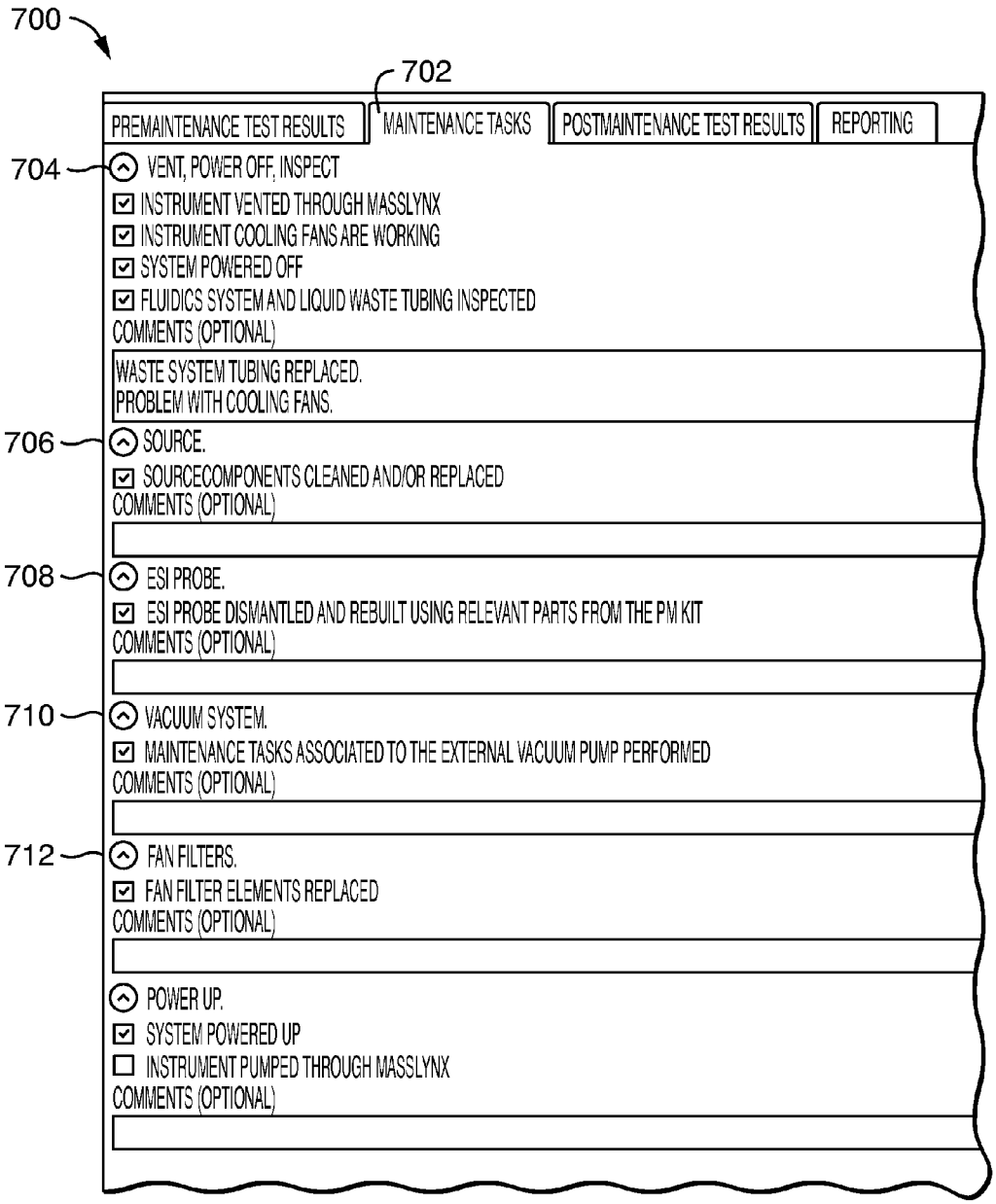

After completion of the pre-maintenance testing with reference now to FIG. 6, the user may select tab 702 and complete the PM activities based on the displayed maintenance checklist of the example 700. The example 700 lists examples of PM activities for the particular MS instrument. As will be appreciated by those skilled in the art, the particular PM activities performed at a point in time for a particular instrument may vary with the required maintenance at a point in time. Additionally, the particular PM activities may vary with the technology and components of the particular MS system. As each maintenance activity in the list of 700 is completed, the user may check off the corresponding displayed item.

As indicated by 704, maintenance activities may include inspecting aspects of the instrument system to ensure proper venting and cooling (e.g., that cooling fans are working), that the system is powered off, and that the fluidics system and liquid waste tubing pass a visual and possibly other inspection. As indicated by 706, maintenance activities may relate to the ionization source of the MS system and cleaning and/or replacing parts thereof. As indicated by 708, maintenance activities may relate to the ESI (electrospray ionization) apparatus used to generate ions as part of the ion source of the particular MS system. ESI is one technique known in the art to generate ions through an electrospray whereby droplets undergo evaporation and breakup into smaller droplets, which lead to the generation of ions that enter the MS system for analysis. The use of the foregoing electrospray process to generate ions for mass spectral analysis by the MS device is known in the art as described, for example, in U.S. Pat. No. 4,531,056, Labowsky et al, Issued Jul. 23, 1985, METHOD AND APPARATUS FOR THE MASS SPECTROMETRIC ANALYSIS OF SOLUTIONS, which is incorporated by reference herein, and as also described in The Journal of Chemical Physics (1968), Vol. 49, No. 5, pp. 2240-2249, Dole et al., "Molecular Beams of Macroions", which is incorporated by reference herein.

As illustrated in connection with 708, maintenance activities may include dismantling the ESI (source) probe and rebuilding this using one or more new parts. As indicated in 700, maintenance activities may also relate to a vacuum system including an external vacuum pump (see 710), fan filters (712), and other components. It should be noted that different possible maintenance activities may be required at another point in time for the same MS instrument.

Figure 7:
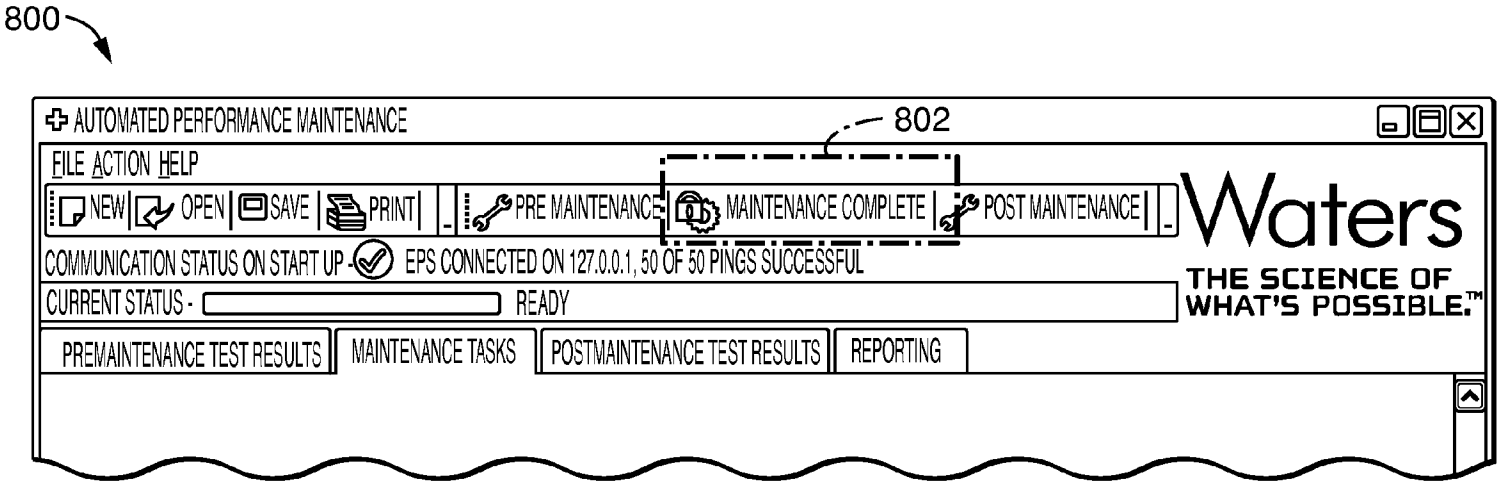
Figure 8:
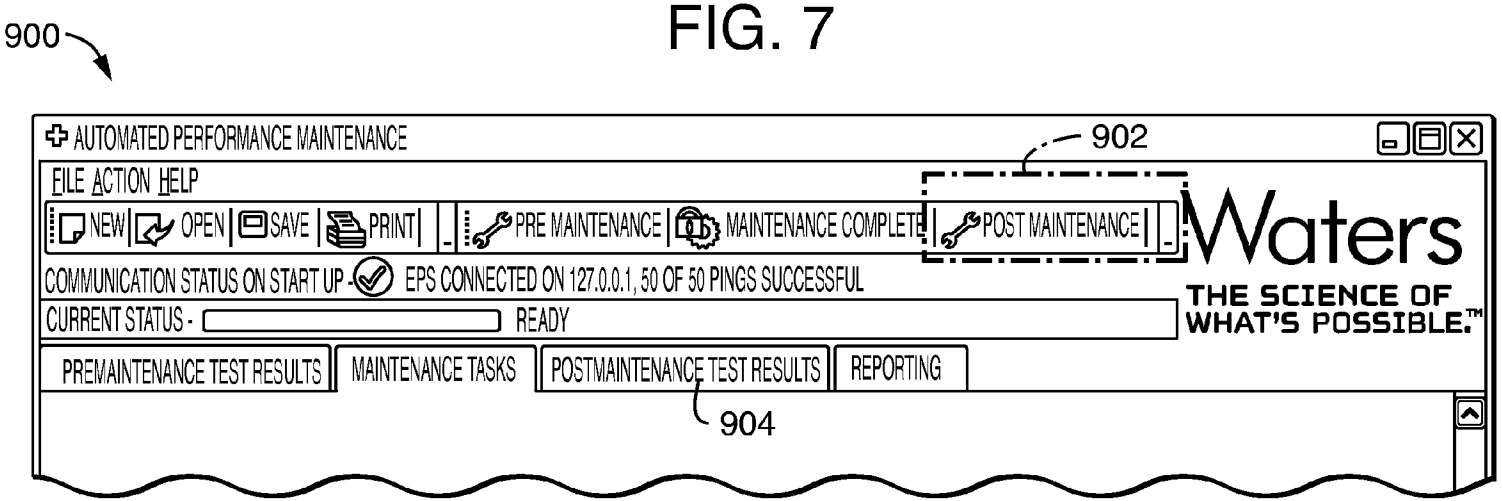

Once the maintenance activities denoted by the checklist of 700 have been completed as denoted by the user checking the box next to each item, the user may select the maintenance complete button 802 as illustrated in FIG. 7. In response to selection of 802, the application may perform processing to ensure that each item required in the checklist has been so checked denoting confirmation of item completion. If all listed items from the example 700 have been verified by the application as having been checked off as completed, the post maintenance button 902 may be enabled as displayed in FIG. 8. It should be noted that prior to selection of 802 and verification by the application that all activities of 700 have been completed, the post maintenance functionality of the application may not be enabled. Thus, a user is forced to complete the steps of checking off that each PM activity of the example 700 is completed prior to performing post-maintenance testing as associated with enabled functionality of button 902. At this point, the user may select 902 to perform post-maintenance testing and subsequent benchmark comparison of pre and post maintenance testing results and data.

Figure 9A:
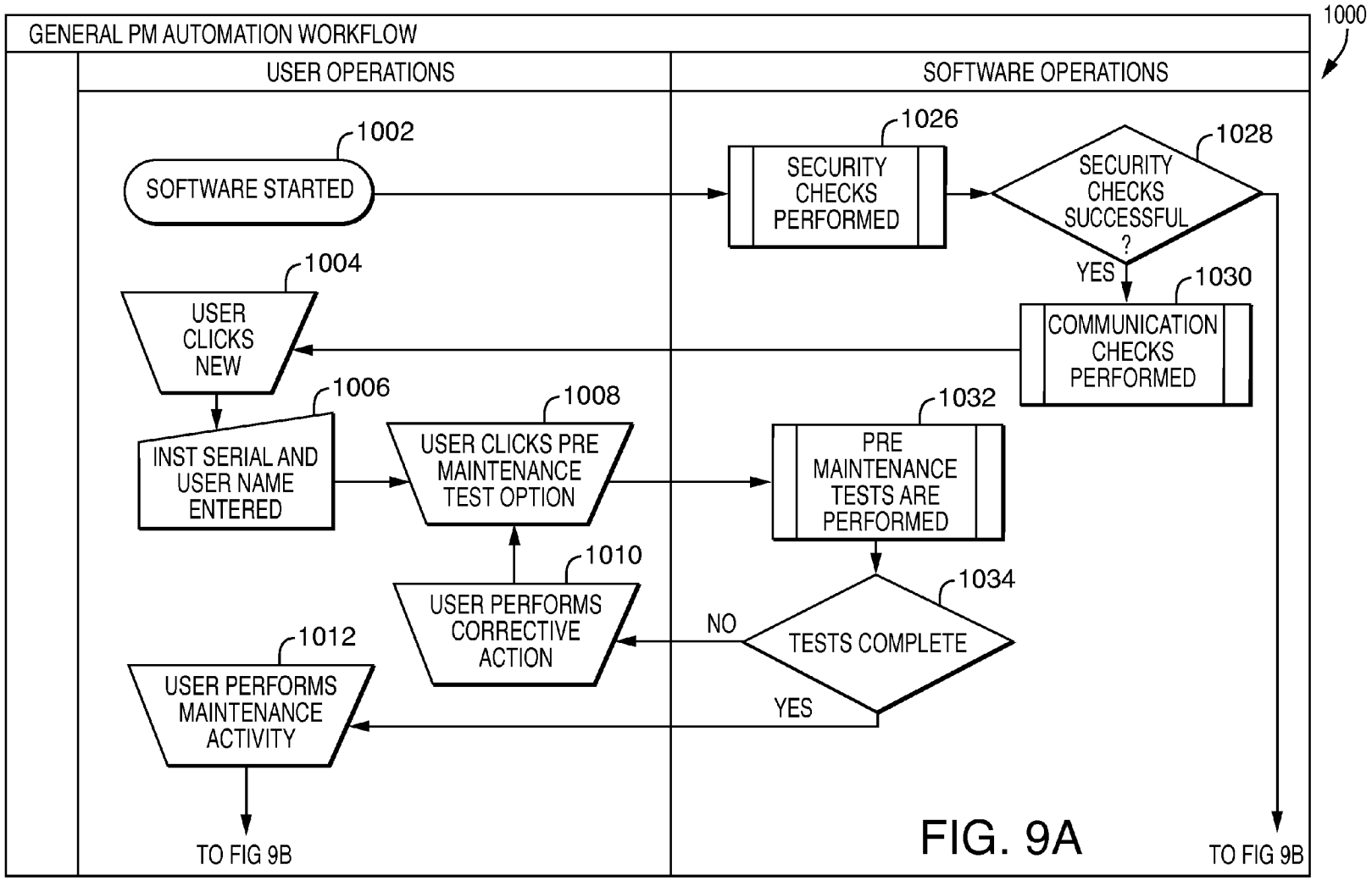
FIGS. 9-12 are flowcharts of processing steps that may be performed in an embodiment in accordance with techniques herein.
Figure 9B:
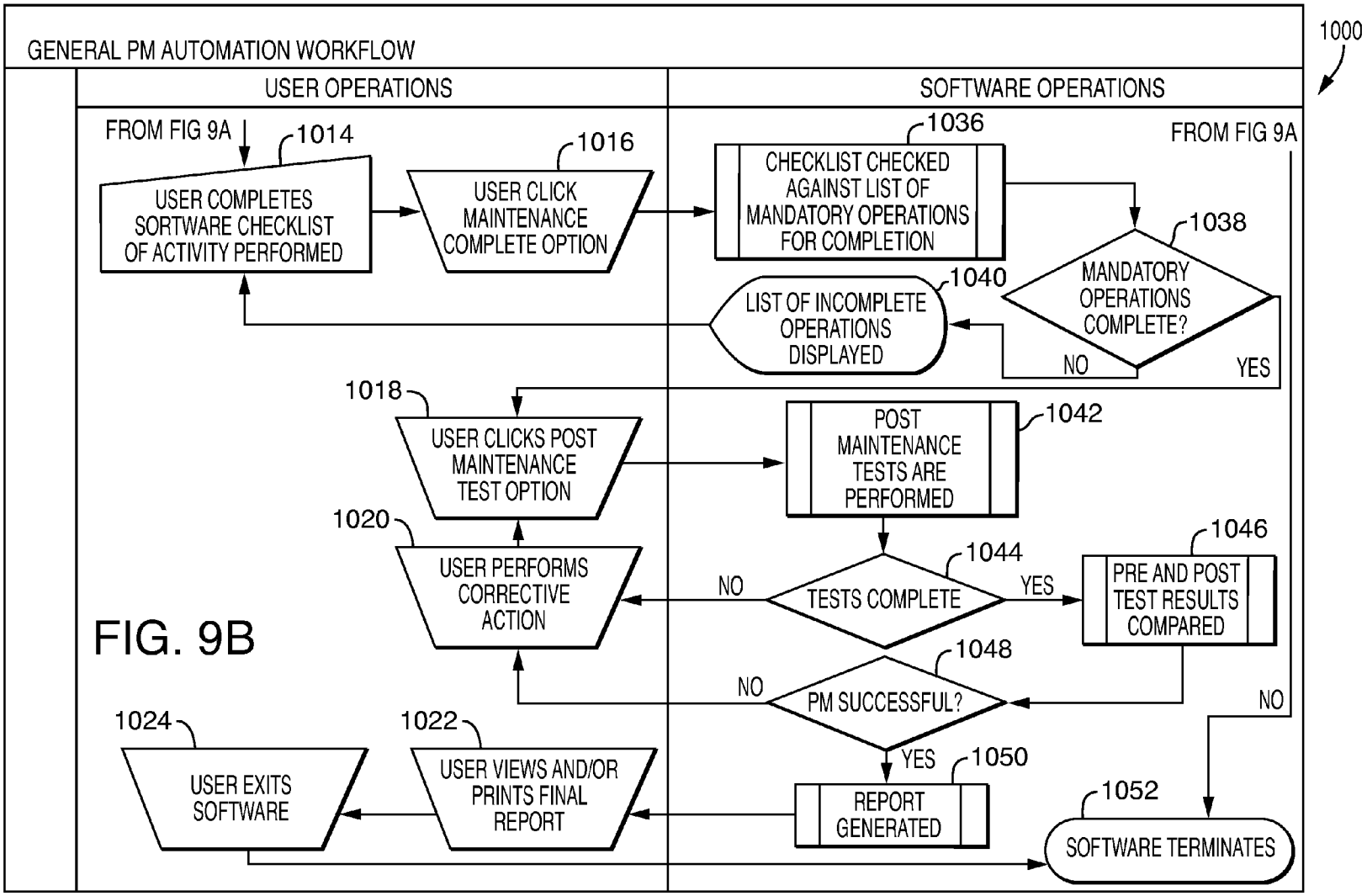

Referring to FIG. 9, shown is a flowchart of processing as may be performed in an embodiment in accordance with techniques herein for PM automation workflow. The flowchart 1000 generally summarizes processing as illustrated in connection with the preceding example with user operations and the underlying software operations performed in response to the user operations. The user operations on the left side of 1000 are those user actions such as user inputs via the UI. The software operations on the right side of 1000 are those performed in response to the associated user action on the left side. At step 1002, the application is started such as by launching the application on a computer system in communication with the MS system. In response, security checks may be performed in step 1026. Step 1026 includes performing a password generation algorithm based on a fixed keyword which provides a new password based on the keyword and calendar month. The security feature generates the password when the user first opens the software application. The program checks for a password file in the program folder. If the password in the password file does not match that generated by the program or the password file does not exist, then the user is prompted to enter a valid password. A valid password may include the user knowing a previously determined password used as part of the authentication process. If the user enters a valid password or the password in the file matches that generated by the program, the program continues to run, otherwise the program terminates. This security feature is designed such that once a user has entered a valid password, they can use the program without entering a password again until the end of a defined period of time, for example a calendar month, at which point a new password will need to be entered.

At step 1028, a determination is made as to whether the security checks at step 1026 are successful. If not, processing proceeds to step 1052 where the application terminates. Otherwise, processing proceeds to step 1030 where communication checks are performed. Step 1030 may include ensuring that the computer system upon which the application is executing has appropriate network connections, is able to pass initial communications tests.

In one embodiment, step 1026 may include performing processing as will now be described. During the communication testing of step 1026, the local domain name server may be checked for an entry identifying the embedded PC (which is the mass spectrometer control computer or EPC as discussed elsewhere herein) and the associated network address is displayed to the user for confirmation. If the user believes the registered EPC address to be incorrect, the user may be given the opportunity to enter a corrected address. Once the address for the embedded EPC is confirmed or corrected, the given address is "pinged" once. As known in the art, "pinging" refers to sending a network PING command to the address to test if the recipient received the command. The PING command may be used in determining if a recipient is connected to an existing network and able to communicate with the sender of the command. If a response is received, the address is then pinged and additional number of times (e.g., for example, such as 50 times at 1 second intervals) and the responses to the subsequent PING commands are evaluated. For example, the foregoing evaluation may be performed by counting the number of consecutive responses (each time a response is not received within 1 second the count of consecutive responses is reset to 0). If there is no response from the initial ping, the communication test is failed indicating no connection to the embedded PC. If the number of consecutive responses falls below 30, the communications test is also failed indicating an intermittent connection to the embedded PC. If the number of consecutive responses is 30 or above, the communication test is passed and the number of responses may be returned to the user along with the tested address. Other embodiments may perform variations to the foregoing in connection with performing any prescribed suitable communications test that tests communication of the mass spectrometer with the computer system, embedded or otherwise, used in issuing subsequent commands such as to control operation of the mass spectrometer.

From step 1030, processing proceeds to step 1004 where the user selects the new option as described above in connection with FIG. 2. The user is then prompted to enter the instrument serial number and user name as described above in connection with FIG. 3. At step 1006, the user selects the pre maintenance test option as described above in connection with FIG. 4 to initiate automated performance of the pre-maintenance tests in step 1032 by the application. At step 1034, a determination is made by the application as to whether the pre-maintenance tests have completed. As described herein, the pre-maintenance tests are allowed to run to completion unless there is a critical threshold test failure. Failure of a non-critical threshold test such as the resolution test 618 at this point will not cause the pre-maintenance testing to terminate. As such, step 1034 evaluates to no only if there has been a critical threshold test failure thereby requiring a user to perform a corrective action in step 1010. After the corrective or remedial action is performed in step 1010, the user may elect to resume pre-maintenance testing in step 1008 to resume such testing from the point of failure so that retesting of the failed critical test is performed. If the previously failed critical threshold test is now successful or passes, any subsequent tests in the sequence for pre-maintenance testing are also be performed.

If step 1034 evaluates to yes in that pre-maintenance tests have completed, the application may now enable functionality in connection a next step of the PM process for performing the maintenance activity. As described above, the user may perform the required PM activities in step 1012 and then complete the checklist of activities performed in step 1014. An example of a checklist of PM activities is illustrated in FIG. 6 as described above. Once the activities are completed and confirmed by the user by checking off each item in the displayed list, the user may select the maintenance complete menu option as described in connection with FIG. 7. At step 1036, the application performs processing to ensure that the user has confirmed performing each listed maintenance activity. At step 1038, a determination is made as to whether all required PM activities have been performed and confirmed. Step 1038 may include the application ensuring that the user has checked off all required activity items in the list as in FIG. 7. If step 1038 evaluates to no, processing proceeds to step 1040 where a list of the incomplete activities are displayed and control proceeds to step 1014. If step 1038 evaluates to yes, processing proceeds to step 1018 where the user selects to proceed with the post-maintenance testing as described in connection with FIG. 8.

In response to selection of the option in step 1018 to perform post-maintenance testing, the application performs the post-maintenance tests in step 1042. At step 1044, a determination is made as to whether all tests in the post-maintenance testing sequence have completed. In a manner similar to that as described above in connection with step 1034, step 1044 evaluates to no only upon failure of a critical threshold test whereby processing proceeds to step 1020 for the user to perform appropriate corrective or remedial actions. From step 1020, processing proceeds to step 1018 to resume post-maintenance testing beginning with the previously failed critical threshold test. If step 1044 evaluates to yes, processing proceeds to step 1046 to perform the benchmark comparison of pre and post maintenance test results. For example, if a first value of a metric is obtained for a test during pre-maintenance testing and a second value of the metric is obtained as a result of executing the same test as part of the post-maintenance testing, step 1046 may include comparing the first and second values to determine whether the second value (indicative of MS performance after performing the PM activities) represents a performance measure that meets or exceeds a performance measure represented by the first value (indicative of MS performance before or prior to performing the PM activities).

Step 1048 determines whether the PM was successful. Step 1048 may determine that the overall PM was successful if the post-maintenance test results indicate that the MS system performance is the same or better than as represented by the pre-maintenance test results. In one embodiment as described herein, step 1048 may include comparing test data and results from tests performed before and after performing the PM activities such as comparing metric values indicative of various MS performance measures as may be associated with, for example, any one or more of non-critical threshold tests and/or critical threshold tests (where the same such tests are included in pre and post maintenance testing sequences). Additionally, some embodiments may optionally also include other evaluation criteria in connection with step 1048 evaluation. Such other criteria may include the testing outcome or status of one or more individual tests. For example, as described elsewhere herein in more detail, such other evaluation criteria which may be used in combination with comparing performance benchmarks of pre and post maintenance testing may include performing one or more additional tests in the post-maintenance testing sequence (e.g., such as step 1232 of FIG. 11) where each such test has a resulting test status provided as an input into step 1048 processing when evaluating the overall success or failure of the PM process. As another example, an embodiment as described herein may perform one or more of the non-critical threshold performance tests as part of both the pre and post maintenance testing sequences (e.g., FIGS. 10 and 11). Some embodiments may require that the performance benchmark level of such non-critical threshold tests of post maintenance either indicate the same or improved performance results in comparison to pre-maintenance performance benchmark levels as described above. However, these same embodiments may also allow both pre and post maintenance testing performance benchmark levels to be below the acceptable threshold and thus fail the non-critical threshold test even though the pre and post performance testing benchmarks indicate that performance has not decreased. As a variation to the foregoing, an embodiment may require that each of one or more of the non-critical threshold tests performed in both pre and post maintenance testing (e.g. gas cell charging test of steps 1126 and 1226 as described elsewhere herein) have a success status in the post-maintenance testing sequence in addition to the requirement that the pre and post performance testing benchmarks indicate that performance has not decreased. Thus, the pass or fail testing status of a non-critical threshold performance-based test (e.g. gas cell charging test of step 1226) in the post maintenance testing sequence may be included in this other criteria of step 1048 to be used in addition to performance benchmark comparisons (of performance-based tests executed in both pre and post maintenance testing) when performing the overall PM evaluation.

Step 1048 may evaluate to yes indicating that the PM was successful only if all post-maintenance test results indicate that the MS performance is the same or better than prior to performing the PM as represented by the pre-maintenance test results. For example, if 4 tests are performed as part of pre and post maintenance testing, results of all 4 tests may be required to indicate the same or improved MS performance post-maintenance for step 1048 to evaluate to yes.

If step 1048 evaluates to no, control proceeds to step 1020 where the user performs one or more corrective actions to address the adversely indicated performance by the particular test that failed the pre/post benchmarking performance comparison of step 1046. From step 1020, the user may resume post maintenance testing whereby all post-maintenance tests may be reperformed (e.g., all tests in the post-maintenance testing sequence are re-executed). If step 1048 evaluates to yes, control proceeds to step 1050 where a report may be generated. In one embodiment, the report may be a WPF (Windows Presentation Foundation) document or other type of document such as one in accordance with XML. The report may be displayed in an appropriate document viewer embedded in a reporting tab of the UI. The application may provide for resizing the report as needed for printing and/or displaying in step 1022. The report may include, for example, the results from pre-maintenance testing, a list of the maintenance activity/ies performed, the results from post maintenance testing, a comparison report, a customer signoff section, and possibly other information as may vary with embodiment. On generation of the report, the user may be prompted to enter the customer details (e.g., company and customer name) which may be included on the report under a confirmation section. Subsequently, the user may exit the application in step 1024 causing the software to terminate in step 1052. It should be noted that implicit in the foregoing process as mentioned elsewhere herein, the application may save testing data, results, testing state information (e.g., such as related to what tests have been completed) allowing the testing process to resume at a later point in time, and the like, associated with the PM processes completed as well as in progress/incomplete.

In connection with the foregoing description such as illustrated in connection with step 1008 when the pre-maintenance test option is chosen, the application checks the current state of testing. If no testing has yet been performed the testing process is started from the beginning and runs through to completion or until a critical threshold test fails. If testing has been started and previously terminated due to a critical threshold test failure, the testing is restarted with the failing test and runs through to completion or until a critical threshold test fails. When the pre-maintenance testing process is complete as indicated by step 1034 evaluates to yes, the maintenance activity checklist and menu option is enabled and the pre-maintenance option is disabled. When the maintenance complete option is chosen by the user such as in connection with step 1016 above, the application displays to the user any mandatory maintenance activity items that have not been confirmed. If all mandatory operations are confirmed (as in step 1038 evaluating to yes), the maintenance checklist in the displayed UI is disabled, the maintenance complete option of the UI is disabled and the post-maintenance test option of the UI is enabled.

When the post-maintenance test option is chosen by a user such as in connection with step 1018 above, the application checks the current state of testing. If no testing has yet been performed, the testing process is started from the beginning and runs through to completion or until a critical threshold test fails. If testing has been started and previously terminated due to a critical threshold test failure, the testing is restarted with the failing test and runs through to completion or until a critical threshold test fails. When the post maintenance tests are complete (as determined by step 1044 evaluating to yes), the post-maintenance option menu option is disabled and the final report is generated.

As described herein, the pre-maintenance and post maintenance testing procedures falls under the category of benchmark testing. The notion of a performance maintenance visit is that the mass spectrometer performance is benchmarked before and after any maintenance activity. The results after maintenance is expected to indicate that the performance is the same or improved upon the performance before the maintenance.

The pre-maintenance testing runs instrument specific tests to benchmark the instrument performance in a sequence appropriate to the instrument. In one embodiment described elsewhere herein, each test may be implemented as a separate class such as a separate C# class. The testing process performs a test and displays the result to the user in a format appropriate to the type of data analysed. If the test is a critical threshold test and does not pass, the overall testing process may be terminated and testing will recommence with this test on request. If the critical threshold test passes or it is not a critical threshold test, the procedure will perform the next test in the sequence until each test is complete. Results may be reported to the user on completion of each test. The post-maintenance test sequence is similar to the pre-maintenance test procedure with the addition of a comparison of benchmark testing results to determine the overall success of the performance maintenance performed. If the performance after maintenance is the same as or better than performance before the maintenance, then the process is complete. Otherwise, if not, the post-maintenance testing and benchmark comparison of pre and post maintenance performance may be repeated until the overall result is successful. The overall result of successful PM testing may be indicated as described above, for example with step 1048 evaluating to yes.

What will be described in more detail is processing as may be performed in connection with pre-maintenance testing of step 1032 and post-maintenance testing of step 1042. Exemplary processing of 1032 and 1042 will be described as including particular tests in a sequence with reference back to the screenshots such as of FIGS. 2 and 5.

Figure 10:
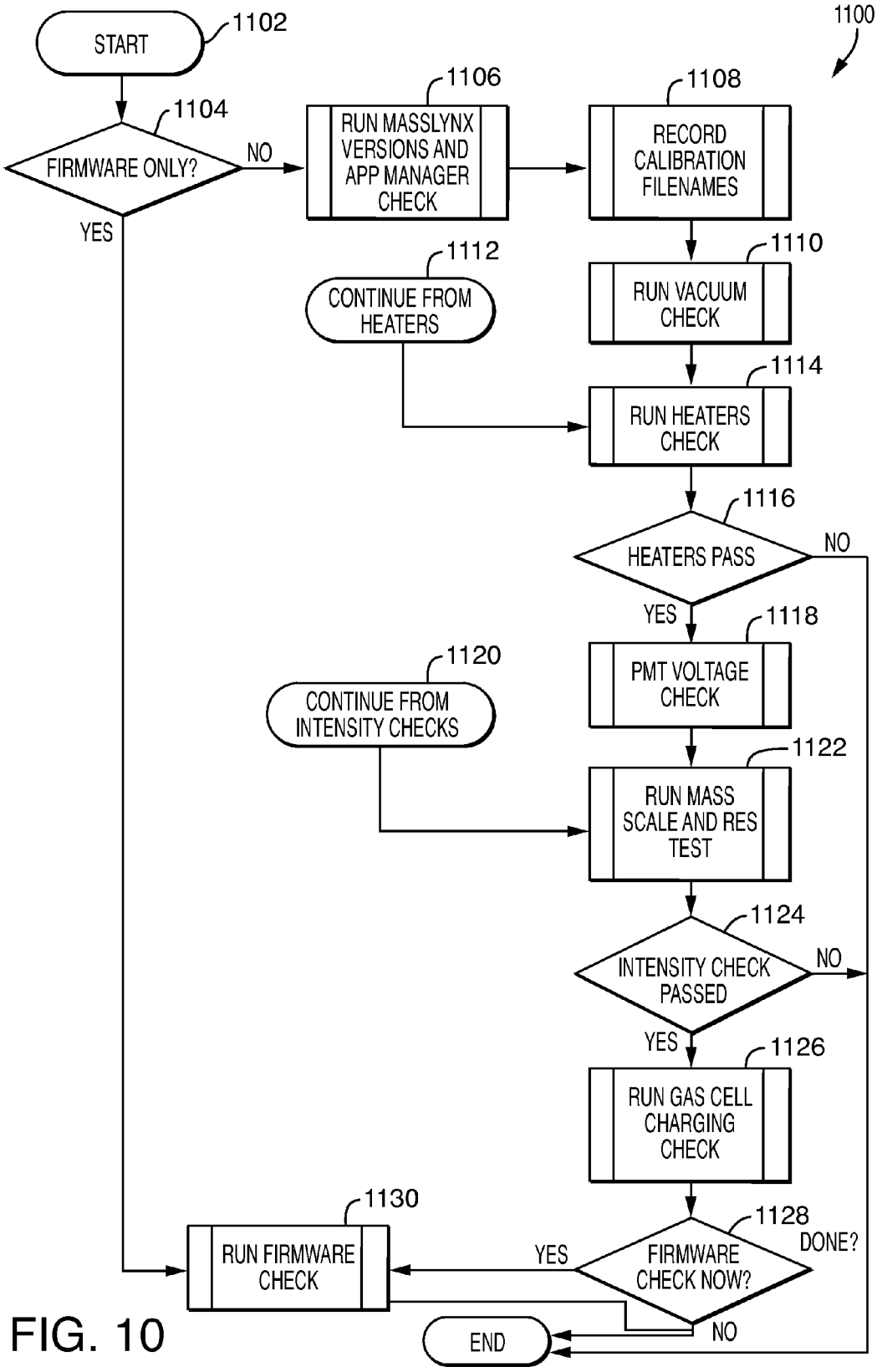

Referring to FIG. 10, shown is an example of pre-maintenance testing that may be performed for an MS instrument. The flowchart 1100 provides additional detail that may be performed in connection with step 1032 of FIG. 9. It should be noted that the particular tests performed may vary with different attributes of the MS instrument under test such as, for example, whether the MS is TOF or includes one or more quadrupoles, the techniques used in connection with the ion source generating ions, and the like. The tests described herein may be used in connection with testing sequences for the Xevo™ TQ Mass Spectrometer by Waters Corporation which is a triple quadrupole MS system. Other aspects and components of this particular commercially available MS system will become apparent as particular tests are described in following paragraphs. Pre-maintenance testing is commenced in step 1002 and processing proceeds to step 1104 where a determination is made as to whether testing is being performed for only firmware. If so, control proceeds to step 1130 where a firmware check is performed. Step 1130 may include, for example, checking whether a particular version or revision of firmware is installed on the MS system, computer system embedded or integrated in the MS system or otherwise installed on the computer system in communication with the MS system. In one embodiment, step 1130 may be a non-critical threshold test which may check, for example, that a particular or minimum version of firmware is installed, as well as other checks. If this is a firmware-only testing sequence, control proceeds from step 1130 to the end and the pre-maintenance testing stops. As described below, step 1104 may evaluate to true/yes for a firmware-only testing if, for example, firmware testing of step 1130 was previously deferred and is now being performed as the only remaining test of the pre-maintenance testing process.

If step 1104 evaluates to no, control proceeds to step 1106 to perform various software checks such as gather and collect information regarding various software libraries, applications, operating system, and the like, which may be installed on the instrument and/or computer system in communication therewith. Step 1106 may include collecting and displaying such information, for example, in areas 602 and 604 of FIG. 6. For example, with reference back to FIG. 6, areas 602 and 604 display information on the commercially available MassLynx™ Mass Spectrometry Software and its application manager from Waters Corporation. Waters MassLynx™ Software may provide functionality used in connection with instrument control and may be characterized as a platform including software to acquire, analyze, manage, and share mass spectrometry information. The particular version for the MS system may be acquired by automatically obtaining information about such software installed from the MS system and/or computer system connected thereto. Additionally, this particular software package may include a type of application manager indicated by 604 where each application manager may provide a particular set of functionality. Processing of the test performed in step 1106 may be characterized as informational. An embodiment may also perform a non-critical threshold test as part of step 1106, for example, to ensure that the installed software is of a minimum supported version.

From step 1106, processing proceeds to step 1108 to record or collect calibration file names. Step 1108 may include collecting or displaying calibration files available for use with pre-maintenance testing in subsequent steps. The calibration files may be displayed, for example, in area 606 of FIG. 5. The calibration filenames processing of step 1108 may be performed for information collection only and is not used in subsequent pre-maintenance testing procedures of FIG. 10. The reason for its placement in the overall workflow of FIG. 10 is for convenience in the pre-maintenance routine. However, as described elsewhere herein in connection with post-maintenance testing in an embodiment, calibration filename processing may again be performed. In connection with such post-maintenance testing, it should be noted that the placement or ordering of this test is specific and purposeful because calibration (e.g., step 1228 of FIG. 11) is performed prior to calibration file detection (e.g., step 1208 of FIG. 11) and step 1208 is performed in the prescribed order after step 1228 to collect the name of the calibration files generated as a result of step 1228 processing.

From step 1108, processing proceeds to step 1110 to perform one or more vacuum checks. Step 1110 may include obtaining pressure readings from one or more components of the MS system and checking whether the acquired pressure readings are in accordance with a non-critical threshold. The acquired pressure readings and an indication as to whether the measured pressures are in accordance with a non-critical threshold may be displayed, for example, in area 608 of FIG. 5. Step 1110 may be characterized as a non-critical threshold test. In this particular example of 608 of FIG. 5, the pressure readings measured and tested with a non-critical threshold may be those of the three quadrupoles of the MS system where MS1 Pirani pressure denotes the vacuum level in the analyser in the region of the first quadrupole mass analyzer (Q1 functioning as a mass analyzer) in the MS system as measured with a pirani gauge. MS 2 Penning pressure denotes the vacuum level in the analyser in the region of the second quadrupole mass analyzer (Q3 functioning as a mass analyzer) in the MS system as measured with a penning gauge. Collision cell penning pressure denotes the vacuum level in the analyser in the region of the collision gas cell as measured with a penning gauge. The collision gas cell (in Q2) in this example is a transverse wave ion guide which is an ion optic device that serves to transfer ions from the first quadrupole mass analyser to the second quadrupole mass analyser with a second function of fragmenting the ions for MS/MS analysis.

Processing proceeds from step 1110 to step 1114 where a heaters check is performed. Step 1114 processing is described in more detail below and may include testing to determine whether one or more heaters of the MS system are functioning properly. The heaters check of step 1114 is a critical threshold test as determined by the check at step 1116 whereby if the test fails as determined by step 1116, the pre-maintenance testing terminates. Upon failure of the heaters check of step 1114, processing may be resumed at a later point at step 1112 after the user has performed a remedial or corrective action. Information regarding the heaters testing of step 1114 may be displayed, for example, in connection with area 612 of FIG. 5. It should be noted that the MS heaters need to be operational for the spectral data to be as expected and may generally adversely affect any experimental data obtained if not functioning properly. For example, a heater may be used in connection with heating a desolvation gas. As known in the art, an ESI interface of the MS system (such as when interfacing with a preceding LC system), may include a spray source fitted with an electrospray probe. Mobile phase from the LC column or infusion pump enters through the probe and is pneumatically converted to an electrostatically charged aerosol spray. The solvent is evaporated from the spray by means of the desolvation heater. The resulting analyte and solvent ions are then drawn through the sample cone aperture into the ion block, from where they are then extracted into the MS analyzer. Failure to have the desolvation gas heater function properly may affect the ionization source of the MS system.

The critical threshold test of the heaters in step 1114 is performed prior to other subsequent tests whose results may be dependent upon having the heaters test pass. Thus, the particular ordering of the tests in the sequence is predetermined and customized for the particular dependencies between the tests and associated results. Testing is not allowed to proceed beyond the critical threshold test until such test passes since performing any subsequent test has results dependent upon the heaters test passing. If subsequent tests were allowed to proceed despite the heaters test failing, any test results obtained from such subsequent tests may be invalidated and/or the actual subsequent tests may not otherwise be able to be performed.

If step 1116 determines that the heaters test has passed, processing proceeds to step 1118 where the voltage check is performed. Results of the voltage check test may be displayed, for example, as in connection with element 614 of FIG. 5.

As known in the art and in connection with the particular MS under test herein which is the Xevo™ TQ Mass Spectrometer, the ion source of the MS system may use an Atmospheric Pressure Ionization (API) technique that allows positive or negative ions to be detected by a subsequent detector of the MS system. API offers soft ionization resulting in little or no fragmentation. A typical API spectrum contains only the protonated (positive ion mode) or deprotonated (negative ion mode) molecular ion. The detected ion peaks are (M+z)/z and (M−z)/z in positive and negative ion mode, respectively, where M represents the molecular weight of the compound and z the charge (number of protons). As such, the ion source using the API technique may generate positive or negative ions depending on the mode and voltage setting as indicated, respectively, by the positive ion mode and negative ion mode displayed in 614 of FIG. 5. As also known in the art and also noted elsewhere herein, the mass spectrometer under test includes an ion detector. In connection with the particular MS under test herein which is the Xevo™ TQ Mass Spectrometer, the ion detector or ion detection system includes a photo-multiplier tube (PMT). In this example, the PMT voltage check refers to checking and reporting on the voltage applied to the PMT. In this specific ion detection system as known in the art, the ions collide with a surface of polished metal (e.g., referred to as a dynode) held at a high voltage of opposite polarity to the detected ions. The collision produces free electrons which are accelerated towards a thin phosphor disc. The impact of the electrons on the phosphor causes scintillation events which are detected and amplified by the PMT to produce a measurable electrical current in proportion to the number of ions incident on the initial dynode. In this detector system, the voltage applied to the PMT is adjusted to provide fixed amplification on the system in order to fix the amplification of the PMT (as this can vary from unit to unit with the same applied voltage). During the performance maintenance testing, such as in connection with step 1118, the voltage applied to the PMT for both positive and negative ion mode is recorded and reported as in connection with element 614 of FIG. 5. Testing of step 1118 may be characterized as informational.

From step 1118, processing proceeds to step 1122 where mass scale and resolution testing is performed. Step 1122 may be characterized as including performing multiple non-critical threshold tests related to peak width and resolution linearity (e.g., see peak width notation in connection with results 618 of FIG. 5) and peak position (e.g., see peak position notation in connection with results 619 of FIG. 5) indicating a mass position in a generated mass spectrum. For example, the foregoing tests may result in acquiring spectral data and determining the width of a number of spectral peaks across a defined mass range. The data may be checked against peak width and resolution linearity thresholds. For example, in connection with one embodiment, the peak width threshold indicates that the observed peak widths be greater than 0.4 Da (Daltons—a measure of mass to charge ratio) and less than 0.6 Da at full width half maximum so that, in general, peaks that are separated by unit mass values are resolved to 50% of the peak height (unit mass resolution). Resolution linearity may be characterized as a measure of how much the peak widths vary across the mass range. In this illustrated example, for all measured peaks, the spread or variation between any two measured peak widths must be no more than 0.1 Da. During the resolution and mass position test, mass spectral data is acquired and 5 peaks across the mass range 50-2050 Da are analyzed for their peak width and measured mass. The peak widths are measured against the thresholds for peak width and linearity and the peak positions are measured against the recognized reference value for the mass of the analyzed chemical. If the peak width or linearity is outside the defined range the resolution test fails (as indicated by 618 of FIG. 5). If the mass position of any peak is more than 0.5 Da from the recognized reference value, the mass scale test fails (e.g., having results displayed in area 619 of FIG. 5). It should be noted that these thresholds and methods for measurement are specific to this instrument type in the example and may vary for different instrument types. Also, in this example, the same set of acquired mass spectral data may be used for the resolution, mass position and intensity measurements for the step 1122 processing just described.

Step 1122 may also include performing a critical threshold test related to intensity. The critical threshold test as related to intensity may include, for example, acquiring spectral data and measuring intensity of a number of spectral peaks across a defined mass range. The measured intensities may be compared against one or more varying intensity thresholds depending upon the particular analysis performed for testing in an embodiment. For example, in this particular testing instance, 5 peaks, representing a chemical mixture, are analyzed with each such peak having a different expected response in the spectrum. Therefore, multiple thresholds are used as may vary with the particular peak and expected response so that each peak has a different intensity threshold. If the intensity of any peak falls below the threshold, the intensity test fails.

For detected peaks in connection with the resolution and peak position to be valid, the detected peaks need to be of sufficient intensity. For example, such insufficient intensity may result in particular ions not being detectable by the ion detector of the MS system under test. Furthermore, if detected peaks do not have a minimum intensity, such insufficiently low intensities may also similarly invalidate the charging test results performed in step 1126 described below in more detail. The tests are placed in a specific order to ensure the validity of subsequent tests.

The test results of step 1122 processing may be displayed, for example, in area 616 of the UI display as illustrated in FIG. 5. After performing step 1122 testing, a determination is made at step 1124 as to whether the critical threshold test of intensity has been passed. If step 1124 evaluates to no, processing proceeds to terminate the current testing procedure. At a later point in time after a corrective or remedial action has been performed, testing may resume at point 1120. If step 1124 evaluates to yes, processing proceeds to step 1126 to perform a gas cell charging test. In connection with operation of the gas cell, processing of step 1126 determines whether charged species are being undesirably retained in the gas cell (e.g., of a collision cell). In this case charge retention is not desirable and indicates that the gas cell is charging dysfunctionally and retaining charged species. In the operation of the gas cell, it is important that charged chemical species are not retained/delayed in the gas cell as it disturbs the transmission of the species being analyzed. In step 1126 processing, a test is performed comparing first mass spectral data acquired where a relatively long time is allowed for the charged species to dissipate from the gas cell and second mass spectral data acquired where a relatively short time is allowed for the charged species to dissipate from the gas cell. If the charged species are being retained (the gas cell is charging dysfunctionally), the intensity of the data acquired with a short interval between scans will be significantly lower than that acquired with a long interval between scans. Analysis in this way allows us to determine if the gas cell needs to be cleaned/replaced as indicated by a difference in the intensities (e.g., perhaps exceeding some acceptable threshold of difference) between the foregoing first and second mass spectral data sets.

In connection with mass spectrometry and ionizing a precursor ion to produce characteristic fragments thereof, a collision energy (CE) voltage is selected to impart a desired CE to ions transmitted to the collision cell. The CE may be selected, such as from a lookup table of empirically derived CE values, as a function of the precursor's m/z value or mass and charge state. A collision cell may include a chamber into which an inert gas or a mixture of gases is introduced. The CE is imparted by selecting and applying the CE voltage to induce collisions of the molecules of atoms of the gas of the collision cell. For a given collision gas at a particular pressure, the optimum CE voltage for collision induced fragmentation such as in the collision cell generally varies with respect to the mass and charge state of the ion to be fragmented. Other factors of the precursor ion to be fragmented which affect the optimum CE desired for fragmentation include the composition of the ion to be fragmented. Ion composition relates, for example, to the number and/or type of amino acids comprising the ion. The amount of energy required to cause sufficient fragmentation by breaking peptide bonds varies with this composition for each ion as the ion elutes.

In connection with the gas cell charging test of step 1126, application of a certain CE voltage to a properly working collision cell is expected to result in producing certain detectable ions. For example, application of a certain CE voltage to such a properly working collision cell is expected to result in fragmentation of a particular precursor ion thereby generating certain fragment product ions from the particular precursor. To confirm that the imparted CE voltage properly and sufficiently charges the collision cell thereby generating the expected product ions, testing may be performed to detect the presence and intensities of such expected product ions in generated spectrum.

In order to be detectable, the product ions must have a minimum intensity. Thus, generally, if the intensity values of any ions output as a result of the mass scale and resolution test are less than a threshold intensity, other intensity values of ions may also be insufficient and may invalidate the charging test results. In other words the fact that certain expected ions were not detected as a result of the imparted CE voltage may be due to either the fact that such ions were produced and retained in a dysfunctional gas cell or were produced and not retained in the gas cell but also not detectable due to their intensities being insufficient (e.g., resulting in false negative test results).

The charging test of step 1126 may be characterized as a non-critical threshold test which measures function of the gas cell and indicates whether maintenance (e.g., cleaning, replacement, and the like) is necessary. The test result may be a pass or fail indicator and may be displayed in a portion of the displayed pre-maintenance test results (e.g., such as of FIG. 5). It should be noted that, as described in connection with step 1226 of FIG. 11, the outcome or result of success or failure of this test during post-maintenance testing is used in connection with the overall PM evaluation performed at step 1048 of FIG. 9 (e.g., if this test fails in the post maintenance testing sequence of FIG. 11, step 1048 of FIG. 9 evaluates to no/false indicating that the PM visit is not successful.

From step 1126, processing continues with step 1128 where a determination is made as to whether firmware check/test is to be performed now. If not the pre-maintenance testing terminates. Otherwise, control proceeds to step 1130 to perform the firmware check/test and then the current testing sequence of pre-maintenance testing terminates.

In connection with performing the firmware check/test of step 1130, it should be noted that this test may be characterized as optional with respect to whether it is to be run as part of the current testing sequence at the moment, or whether performing this test of the pre-maintenance test is otherwise delayed to a later point in time. If this test is performed as part of the current testing sequence at the current point in time, step 1128 will evaluate to yes to cause the test to be performed. Otherwise, at the current point in time, step 1128 evaluates to no and the current sequence terminates. At a later point in time, the pre-maintenance testing sequence may be performed and step 1104 will evaluate to yes thereby indicating that only the firmware test remains to be completed as part of the pre-maintenance testing in order to allow processing subsequent to the pre-maintenance testing to be enabled/performed.

A user may desire to delay performing the firmware check/test of 1130 for any one or more reasons. For example, the pre-maintenance testing process may be run at a current point in time using a remote connection and the user may not be able to verify that necessary hardware is in place to perform the firmware analysis (e.g., in this example an extra serial communication cable may need to be fitted between the control PC and the instrument in order to perform firmware operations) so it is advantageous to bypass the firmware tests of 1130 at the current point in time and run them subsequently. However, in any event, the pre-maintenance checks are not complete until the firmware checks of step 1130 are performed though and the overall process cannot be continued until the processing of step 1130 has been completed. For example, if the user delays performing step 1130 to a later point in time, the software program embodying the processing may indicate an overall PM testing status whereby the pre-maintenance testing is not yet completed and may disable UI options in connection with subsequent processing such as to perform the actual maintenance activity.

Figure 11:
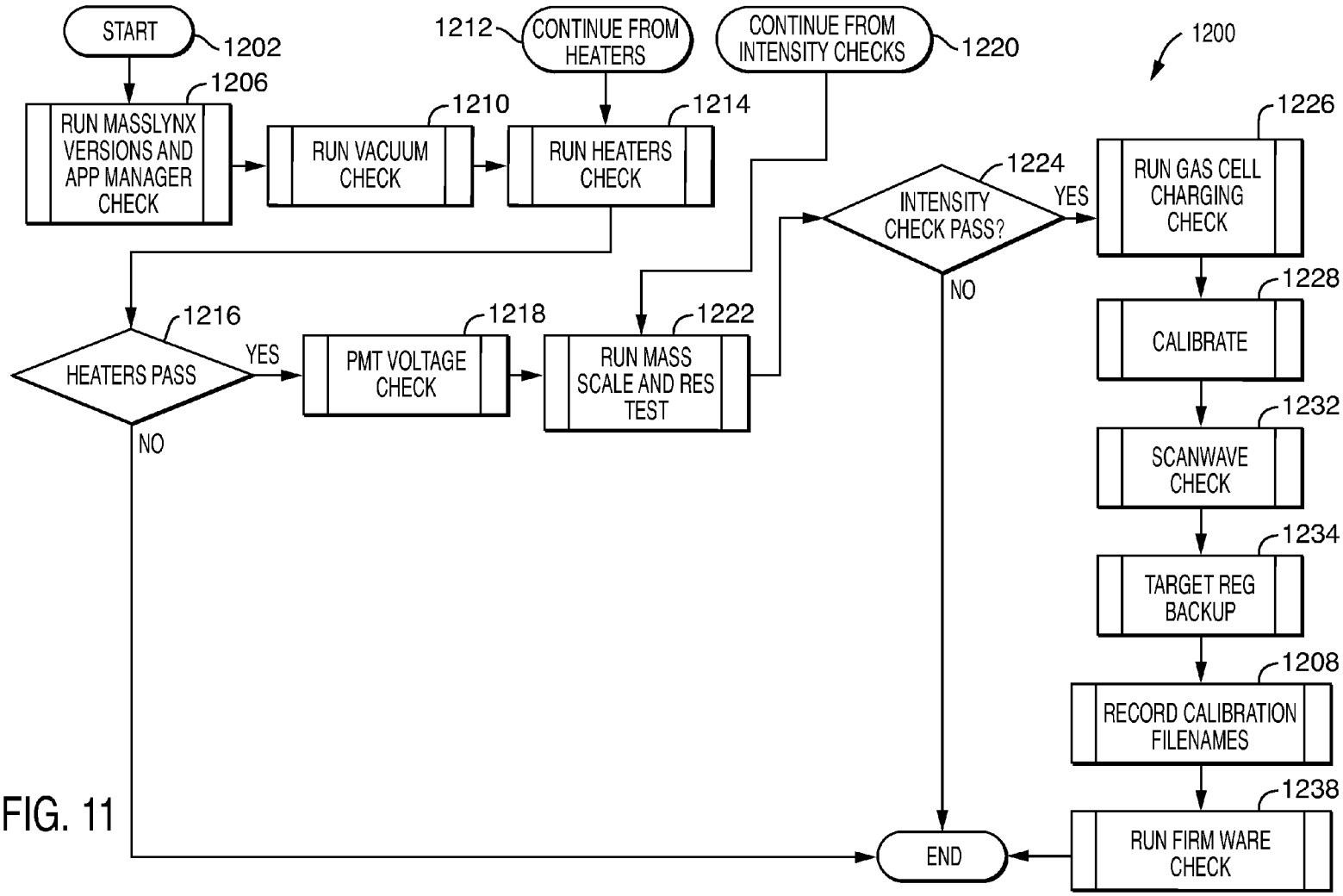

Referring to FIG. 11, shown is a flowchart of processing that may be performed in an embodiment in connection with post-maintenance testing. The flowchart 1200 provides additional detail that may be performed in connection with step 1042 of FIG. 9. It should be noted that, as with pre-maintenance testing, the particular tests performed may vary with different attributes of the MS instrument under test. The processing of steps 1206, 1216, 1210, 1212, 1214, 1218, 1222, 1220, 1224, 1226, 1208, and 1238 of FIG. 11 are similar, respectively, to steps 1106, 1116, 1110, 1112, 1114, 1118, 1122, 1120, 1124, 1126, 1108, and 1128 of FIG. 10. In connection with FIG. 11 processing, the foregoing steps may be used to acquire test data and results similar to as described for pre-maintenance testing. However, processing of FIG. 11 produces test data and results for post-maintenance testing after having performed the necessary PM activities.

It should be noted that generally, non-critical threshold tests that fail in the post maintenance testing such as FIG. 11 do not cause the testing sequence to terminate, are not required to have a passing status prior to considering the post-maintenance testing complete or successful, and do not affect the overall PM evaluation performed in step 1048 of FIG. 9. However, an embodiment may utilize one or more non-critical threshold tests which are exceptions to the foregoing generalization. In this example, step 1226 (gas cell charging test/check) is such an exception. In the illustrated embodiment, step 1226 processing is required to have a successful status or outcome in order for the overall PM evaluation of step 1048 of FIG. 9 to be true/yes. Thus, the resulting outcome of step 1226 processing may be viewed as a logical condition that is used in step 1048 of FIG. 9 processing (e.g., logically ANDed with the resulting outcomes of the benchmark comparisons and possibly other testing outcomes as may vary with embodiment). The outcome of success or failure of this test 1226 during post-maintenance testing is used in connection with the overall PM evaluation performed at step 1048 of FIG. 9 (e.g., if this test fails in the post maintenance testing sequence of FIG. 11, step 1048 of FIG. 9 evaluates to no/false indicating that the PM visit is not successful). From step 1226, processing proceeds to step 1228 to perform a calibration test.

In connection with placement of step 1208, as noted above, it is in a different testing ordering/position than in pre-maintenance testing of FIG. 10 due to the fact that calibration testing is performed in step 1228 and step 1208 is placed in the post-maintenance testing sequence subsequent to step 1228. It should be noted that the post-maintenance testing of FIG. 11 does not provide the user/tester with the option of delaying performing the firmware check/test of 1238.

As described elsewhere herein in more detail, steps 1228, 1232, and 1234 may be characterized as additional tests, procedures or processing performed besides the same set of performance-related checks/tests performed in both the pre and post maintenance testing.

In step 1228, calibration of the MS instrument is performed. As known in the art, calibration of the MS instrument system is a process performed for refining the MS instrument system's mass position and resolution calibration. In connection with an embodiment as described herein, such calibration may be a software-guided process. It should be noted that step 1228 calibration processing is generally targeted to the customer operation level so it may be considered as part of processing performed to make the MS system ready for customer use. In this example, step 1228 processing does not have an outcome or resulting status of success or failure that affects the state of the post maintenance testing or the overall PM evaluation performed in step 1048 of FIG. 9.

After performing step 1228, processing proceeds to step 1232. At step 1232, a ScanWave check test is performed. Regarding step 1232 in this example, which refers to a Xevo TQ instrument type, the gas cell in this instrument as produced by Waters Corporation has a special function which is called a ScanWave enhancement. When testing other MS instrument systems by other manufacturers/vendors, the post maintenance testing may not include such a test as 1232 which is customized for the particular instrument under test in this example. As known in the art, a triple quadrupole MS system such as one under test in this example may be used to perform a product ion mass scan (e.g., also sometimes referred to as daughter scan) where a parent or precursor ion of a particular mass or m/z value is selected in the first stage of mass analysis by a first mass filter/analyzer. The selected precursor ions are then passed to a collision cell where they are fragmented to produce product or fragment ions. The product or fragment ions are then mass analyzed by a second mass filter/analyzer. Thus, there is a constant stream of ions going from the source into the first mass analyzer and the first quadrupole as a mass analyzer/filter is used to select a primary precursor ion. The gas cell is used as an ion guide to transfer the ions to the second quadrupole while fragmenting the primary ion. The final third quadrupole (Q3) is scanned to produce the spectrum (e.g., Q3 may act as a selective mass filter or it can scan the entire spectrum). Under normal operating conditions while the final quadrupole is being scanned, the ions which are not being transmitted are lost (e.g., for example if an ion of mass 100 enters the quadrupole while its instantaneous mass position is 1000, the ion of mass 100 is lost). The ScanWave function in this particular MS instrument system traps ions in the gas cell and releases them at a point where they will be transmitted by the quadrupole, providing an enhancement in detected signal, also referred to as the ScanWave enhancement. In the last third of the collision cell, fragmented ions are accumulated behind a DC barrier to effect ion enrichment. These ions are then released and contained between the DC barrier and an RF barrier at the end of the collision cell. The RF barrier is gradually reduced ejecting ions from the collision cell to Q3. These ions are ejected according to their m/z ratio with heavier ions ejected first. To improve the duty cycle of the instrument, the final quadupole (Q3) is scanned in synchronization with the ejection of ions from the collision cell thereby increasing the number of ions reaching the detector and thus increasing sensitivity. The test performed at step 1232 uses this ScanWave functionality and involves comparing the data from a standard product scan (e.g., as previously produced from an MS system not having or using the ScanWave enhancement) to a ScanWave enhanced product scan as obtained from the current system under test in step 1232. The number of ions detected in the enhanced scan (as well as signal strength such as based on ion intensity) should be should be some amount (e.g., number of times) higher than on the standard scan to pass the test. Thus, step 1232 may include obtaining mass spectra from the MS system with the ScanWave enhancement and ensuring that the number of ions detected in such mass spectra are at least a threshold amount higher than the number of ions of the standard product ion scan. In this example, step 1232 processing does have an outcome or resulting status of success or failure that affects the overall PM evaluation performed in step 1048 of FIG. 9. If the test of step 1232 fails, step 1048 evaluation fails (e.g., evaluates to no).

After performing step 1232, processing proceeds to step 1234. In step 1234, processing is performed to backup a target registry. In this embodiment for this MS instrument system, there are some fixed instrument settings stored in a protected memory area of the embedded PC (EPC) called the Target Registry. In processing of step 1234, a back-up of the contents of that protected memory is made for data security purposes. In this example, step 1234 processing does not have an outcome or resulting status of success or failure that affects the state of the post maintenance testing or the overall PM evaluation performed in step 1048 of FIG. 9.

From step 1234, control proceeds to step 1208 followed by step 1238. After step 1238, the post-maintenance testing sequence terminates.

Generally, for the PM testing, the tests performed as part of pre-maintenance tests (such as illustrated in FIG. 10) are repeated as part of the post-maintenance testing (such as illustrated in FIG. 11) subsequent to performing the maintenance activity. Such tests capture or measure performance aspects of the MS system under test and are performed as part of both pre and post maintenance testing to demonstrate that the intervening maintenance operations have either maintained or improved performance. It should also be noted that the post-maintenance testing such as illustrated in FIG. 11 may also include performing additional tests or operations which were not previously performed as part of the pre-maintenance testing, for example, to ensure that the MS system is ready for use by the customer. With reference to FIG. 11, processing of steps 1228, 1232 and 1234 are examples of such additional tests performed as part of post-maintenance testing which were not performed as part of pre-maintenance testing. These additional tests (e.g., as related to calibration, target registry back up and ScanWave enhancement check in this example with steps 1228, 1232 and 1234) are not considered performance measures or tests that can be effected by the maintenance activity. Rather such tests of steps 1228, 1232 and 1234 are used to verify that the system is ready for use by the customer. In terms of comparison with pre-maintenance checks as part of step 1046 processing, this is obviously not done for these additional tests as there are no pre-maintenance results. Furthermore, the calibration of step 1228 and target registry backup of step 1234 are operations which do not generate results for such comparison.

In a similar manner to the additional tests performed as part of the post-maintenance testing as noted above, other processing performed in connection with the PM process may incorporate other tests which are not performance related. For example, with reference back to FIG. 9, step 1026 performs security checks/tests and step 1030 performs communication checks/tests. In connection with such additional tests and checks, the testing process may be terminated, require correction of any failures, and the like, depending on the particular embodiment and whether success of an individual test is considered essential or sufficiently important to require such success prior to proceeding with subsequent steps. For example, again with reference to FIG. 9, if step 1028 determines that the security checks/tests of step 1026 fail, control proceeds to step 1052 where the software terminates. If the communication checks of step 1030 fail, processing may terminate until such checks/tests are successful due to the fact that such communication failure indicates that subsequent testing steps issuing commands over the failing communication connections to the MS system will also fail.

In this particular example in connection with the results of step 1232 (processing of the ScanWave enhancement test/check), the overall PM process being successful such as determined in step 1048 of FIG. 9 depends on the success of this test 1232 in combination with having the same or improved performance as indicated by comparison of the pre-maintenance and post-maintenance testing results (e.g., step 1046 of FIG. 9). The outcomes or statuses with respect to steps 1228 calibration and 1234 target registry backup are not used in connection with the overall PM process evaluation at step 1048 of FIG. 9.

Figure 12:
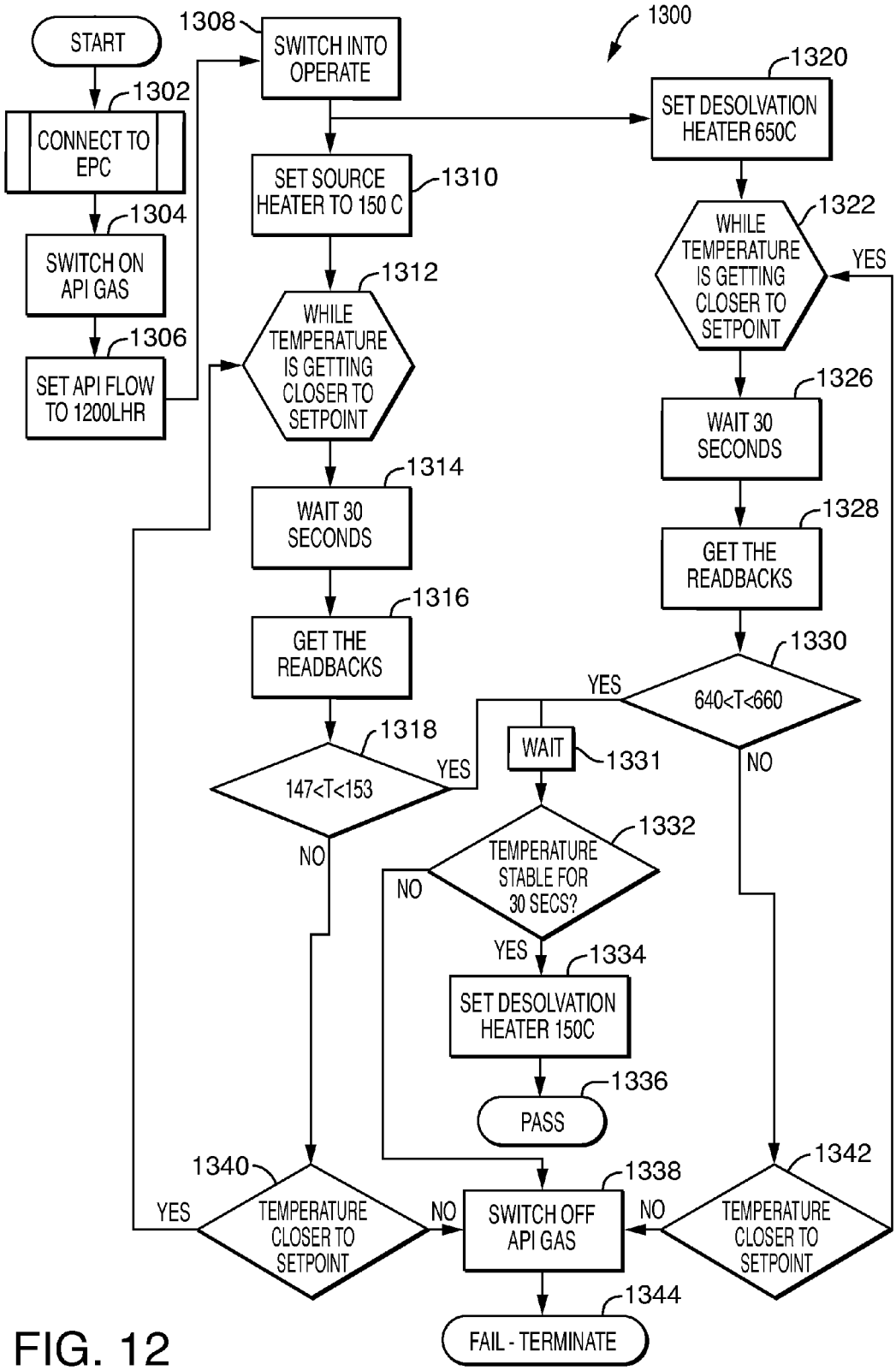

Referring to FIG. 12, shown is a flowchart of processing steps that may be performed in connection with the heaters check test in an embodiment in accordance with techniques herein. The flowchart 1300 provides additional detail regarding processing as may be performed in connection with step 1214 of FIG. 11 and step 114 of FIG. 10. At step 1302, processing is performed to communicate with the embedded or integrated PC (EPC) of the MS system under test. The EPC may be used in connection with communicating with the MS system for control and operation of instrument settings, obtaining observed measurements such as temperature, and the like. At step 1304, processing is performed to turn on the API gas such as used in connection with an ionization source of the MS system. At step 1306, the API gas flow rate is set to 1200 L/Hr. At step 1308, processing is performed to turn "on" the MS instrument system under test. It should be noted that in this embodiment, the one or more heaters may be enabled and may operate without having the MS instrument in an operative state. However, as part of testing in connection with FIG. 12, the heaters are tested with the MS instrument system in an operative "on" state since the heaters testing results may not be considered valid unless so tested with the instrument in an operational state.

Steps 1310, 1312, 1314, 1316, 1318 and 1340 may identify a first series of steps performed in connection with testing a source heater as may be used in connection with the API ionization source gas, and steps 1320, 1322, 1326, 1328, 1330 and 1342 may identify a second series of steps performed in connection with testing a desolvation gas heater. The foregoing first and second series of steps may be performed in parallel in order to overlap testing each of the foregoing two heaters in the MS system.

In connection with the first series of steps denoted above, step 1310 provides for setting the source heater to a desired set point temperature of 150 degrees C. Step 1312 indicates a processing loop performed by the measured temperature is observed as getting closer to the desired set point. At step 1314, processing waits a predetermined time period of 30 seconds. At step 1316, the current temperature of the source heater is obtained and a determination is made at step 1318 as to whether the observed temperature is within the desired set point thresholds (e.g., between 147 and 153 degrees C.). If step 1318 evaluates to no, control proceeds to step 1340 where a determination is made as to whether the current temperature of the source heater is closer to the set point than the previous iteration, if any. If step 1340 evaluates to yes, control proceeds to step 1312. If step 1340 evaluates to no, for example, if the temperature in a current iteration has not increased since the previous iteration thereby indicating an improvement in the current iteration, then control proceeds to step 1338 to switch off the API gas and terminate heaters testing in step 1344 with failure status.

If step 1318 evaluates to yes, control proceeds to step 1331. Step 1331 indicates that a wait is performed until both steps 1318 and 1330 have evaluated to yes. Once both steps 1318 and 1330 have evaluated to yes, control proceeds from step 1331 to step 1332. At step 1331, a determination is made as to whether the current temperature reading remains stable for a time period such as 30 seconds. The temperature may be determined as stable if it remains in the desired range and associated thresholds of step 1318 for 30 seconds. If step 1332 evaluates to no, control proceeds to step 1338. If step 1332 evaluates to yes, control proceeds to step 1334 to set the desolvation heater to 150 degrees C. and terminate testing with pass status in 1336.

In connection with the second series of steps denoted above, step 1320 sets the desolvation gas desired set point temperature to 650 degrees C. At step 1322 while the temperature is getting closer to the set point, control proceeds to step 1326 to wait a time period of 30 seconds. In step 1328, the current temperature of the desolvation gas heater is obtained. In step 1330 a determination is made as to whether the observed current temperature from 1328 is within a threshold amount of the desired set point of 650 degrees (e.g., is the current temperature between 640 and 660 degrees). If step 1330 evaluates to yes, control proceeds to step 1331 to wait until both steps 1318 and 1330 evaluate to yes as noted above. From step 1331, control proceeds to step 1332. The temperature may be determined as stable in step 1332 for the desolvation gas heater if the current temperature remains in the desired range and associated thresholds of step 1330 for 30 seconds. From step 1332, control proceeds to 1334 and 1336 as noted above.

If step 1330 evaluates to no, control proceeds to step 1342 where a determination is made as to whether the current temperature is closer to the desired set point than in the previous iteration. Step 1342 is similar to 1340 described above. If step 1342 evaluates to no, control proceeds to step 1338 and then 1344 where processing terminates with failure status. Otherwise if step 1342 evaluates to yes, control proceeds to step 1322.

In connection with FIG. 12, it should be noted that as explained above in connection with the wait at step 1331, steps 1318 and 1330 must evaluate to yes/true prior to proceeding to step 1332. Additionally, although not explicitly denoted in FIG. 12, if either steps 1340 or 1342 evaluate to no/false, step 1338 may be performed immediately to thereby terminate the test with failure in step 1344.

With reference back to FIG. 9 and steps 1046 and 1048, comparison of pre and post maintenance testing may include comparison of appropriate corresponding metrics to determine whether performance has remained the same or otherwise improved thereby indicating PM success. For those tests not having numeric value results but rather having a status of pass or fail, performance comparisons may result in success or non-degradation of performance of a particular test so long as the test results did not go from pass in the pre-maintenance testing to failure in the post-maintenance testing.

In connection with the foregoing, pre and post maintenance testing may include performing a test sequence of multiple individual tests having a required dependent order in which such tests are performed. Use of the automated techniques as described herein to perform such testing does not allow a user to otherwise vary from the desired testing order or sequence for each of pre and post maintenance testing. Furthermore, it enforces the required general PM processing of pre-maintenance testing, performing the PM activity, performing post-maintenance testing, and performing benchmark comparisons of pre and post testing results. Additionally, if one of the critical tests fails, the defined testing sequence logic may be to terminate subsequent testing until an activity outside of scope of general PM is performed. If you fail a critical threshold test, further testing will stop until repair and successful retest is performed. Use of the foregoing in an automated process as described herein does not allow for a user to vary the testing order or continue testing with subsequent tests if such a critical threshold test has failed.

The PM activity as described herein may be in accordance with a time-based schedule (e.g., perform certain PM activities every month, 3 months, 6 months, etc.) Additionally, an embodiment may determine and schedule appropriate PM activities based on rate of usage as may be appropriate for an instrument. For example, if the instrument is an LC system, PM activities of a time-based schedule may also be based on assumed rates of usage or load. Such time-based scheduled PM activities may be adjusted based on observe or actual usage of a particular LC instrument. In a similar manner, an MS instrument's time-based maintenance schedule may be adjusted based on one or more factors as may be related to load, usage, wear, and the like. Some illustrative and non-limiting examples of what may affect the time based PM schedule may include the number of samples analyzed, the matrix the analytes are contained within (e.g., which may affect the rate at which the system is contaminated), and the number of times the ionization source is changed or replaced (e.g., which may affect the integrity of the seals). Additionally, an embodiment in accordance with techniques herein may perform trend analysis to determine if any additional PM is needed or if a variation from the scheduled PM is needed. For example, an embodiment may perform performance-based conditional PM activities. For example, an embodiment may perform a set of tests at various points in time such as weekly, monthly, and the like in automated manner as described herein. The test data may be collectively analyzed over a time period to identify any trends therein that may indicate decreasing performance over the time period. For example, an MS system may having a component that shows a degradation in performance between testing periods (e.g., such as a decrease in sensitivity over the trended time period) even though each individual testing instance may pass any threshold tests as well as result in a successful PM result in connection with step 1048 processing. However, despite the foregoing successful evaluations at each individual point in time, the test data acquired over multiple such points in time may indicate a trend of decreasing performance. As such an embodiment in accordance with techniques herein may also incorporate performance-based maintenance activity in response to observed performance trends (e.g., decreasing sensitivity over time). In connection with detection of performance trends with respect to testing data over time, an embodiment may utilize one or more predetermined patterns or profiles indicating a particular performance degradation of one or more aspects of a system. Observed or collected test data may be analyzed to determine whether the observed data matches that of the predetermined pattern or profile. Such profiles may include, for example, a predetermined set of metrics which, if observed in collected test data over a time period, may indicate performance degradation requiring additional responsive PM activities. Such profiles may specify conditional maintenance based on detected trends in observed performance over a time period. Use of such trend analysis may allow for earlier detection of defective components and parts.

An embodiment in accordance with the techniques herein may be a software tool or application coded in C# using the Microsoft .NET Framework. The user interface may be coded using the Windows Presentation Foundation (WPF) and may include a menu system, toolbar and tabulated display pages for pre-maintenance testing results, a maintenance activity checklist with optional comments text boxes, post-maintenance testing results and a final report as described elsewhere herein. The instrument type (e.g., denoting an MS instrument system and the particular type of MS instrument system such as related to TOF vs. quadrupole, a particular MS system by a particular vendor, and the like) and test specific parameters used by such a software tool or application may be defined in a configuration file.

The software application in accordance with techniques herein may include a main executable for performing the performance maintenance automation process described herein supported by a hierarchy of functional libraries and interfaces. What will now be described is further detail about how the foregoing may be implemented in one particular embodiment. As will be appreciated by those skilled in the art, this additional detail is only one of many possible the techniques herein may be implemented in an embodiment. In following paragraphs, class libraries that may be used in an embodiment in accordance with techniques herein are described. Subsequently, additional figures and description provide further detail regarding use and interaction of the various classes in connection with a main execution thread such as in a performance maintenance (PM) automation package providing functionality as described herein.

A base class library, referred to as the WEAT (Waters Engineer Automation Tool) base class library, may be defined that includes parameters and methods common to all supported mass spectrometers. The use of the term "WEAT" herein is merely descriptive for illustrative purposes of the example to refer to the particular library. The WEAT base class library may include the base classes and interfaces that are inherited for tests and utilities, log file construction, a web browser display window, embedded PC (e.g., the instrument control unit) control (e.g., command setting via scripted telnet commands and instrument readbacks through use of other libraries), data acquisition and processing such as in connection with MassLynx™ software by Waters Corporation, application security, communication testing and instrument fluidics control. In addition to a base class library, an embodiment may include one or more generic instrument libraries including test classes and utility classes specific to an instrument group such as particular group of MS instruments (e.g., quadrupole MS instruments, time of flight (TOF) MS instruments). Instrument specific libraries may also be defined which include test classes and utility classes specific to an instrument type or particular MS instrument system. For example, an embodiment may utilize a first instrument specific library with a particular MS instrument system such as the Xevo™ TQ-S or Xevo™ TQMS by Waters Corporation of Milford, Mass.

The WEAT base class library may include the 'WEATBaseClass' which is an abstract class inherited by each instrument group class (e.g., where class may be "quadupole" denoting a grouping of one or more types of MS instruments such as several types of quadrupole MS systems). The WEATBaseClass may provide for use of security features, log file features, internal web browser and page control features in the main executable application.

Additionally, an embodiment may also define the following classes in the WEAT base class library with the associated usage and descriptions as outlined in the TABLE 1 of FIGS. 19A and 19B.

In addition to the foregoing classes in Table 1, the WEAT base class library may also include an 'IUtility' interface class and an 'ITest' interface class. The 'IUtility' interface class is inherited by all automation utilities and the 'ITest' interface class. The 'IUtility' interface class is a list of fields, properties and methods implemented for an automation utility. The 'ITest' interface class is inherited by all automation tests, extends the IUtility' interface class, and may be defined in the WEAT base class library. The 'ITest' interface class is a list of fields, properties and methods implemented for an automation test. All automation tests inherit the 'ITest' interface class. The foregoing hierarchical structure is adopted because all automation tests perform those actions as performed by an automation utility as well as additional actions. However, the use of test and utility in a process flow or user interface is similar.

What will now be described in connection with Table 2 of FIG. 20 is an example of classes that may be included in an instrument-level derived class library for an instrument base class. In connection with an embodiment herein, an instrument base class may be created for each instrument group or instrument type as described above.

It should be noted that the ResolutionTest instance, the GainTest instance and the CalFileChecker instance described in connection with Table 2 may be used in connection with functionality and features described elsewhere herein. For example, the ResolutionTest instance of Table 2 may be used in connection with implementing functionality and features of element 318 of FIG. 2, elements 616, 618 of FIG. 5, element 1122 of FIGS. 10 and 1222 of FIG. 11. The GainTest instance of Table 2 may be used in connection with implementing functionality and features of element 318 of FIG. 2, elements 616, 620 of FIG. 5, elements 1122, 1124 of FIG. 10, and elements 1222, 1224 of FIG. 11. The CalFileChecker instance of Table 2 may be used in connection with implementing functionality and features of element 310 of FIG. 2, element 606 of FIG. 5, element 1108 of FIG. 10, and element 1208 of FIG. 11.

What will now be described are figures providing further detail regarding use of the foregoing classes described in connection with Table 1 of FIGS. 19A-19B and Table 2 of FIG. 20 in connection with implementation of a software application, the performance maintenance (PM) automation package, in an embodiment in accordance with techniques herein.

Figure 13:
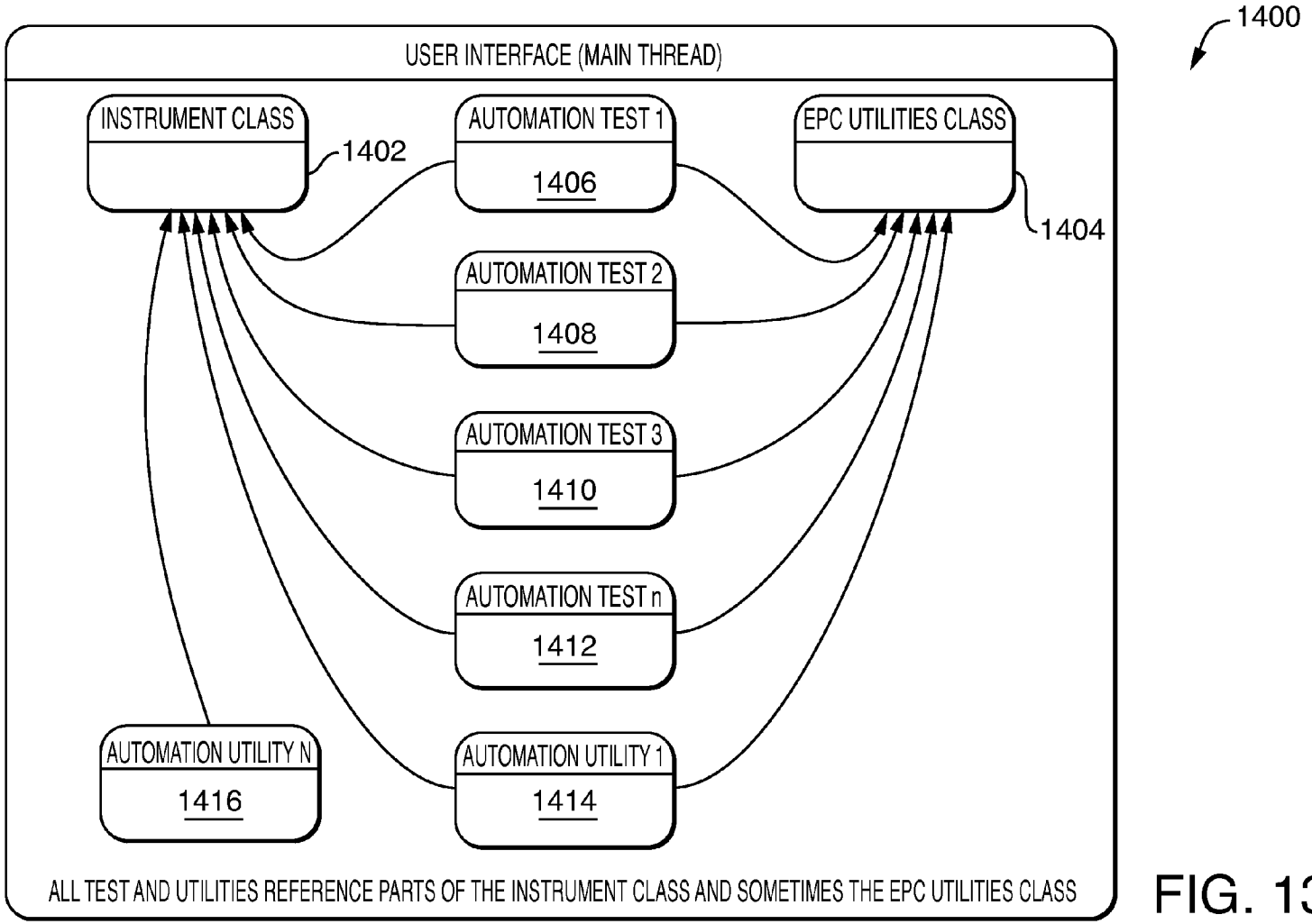
FIGS. 13-16 are examples illustrating use of classes in an embodiment in accordance with techniques herein.

Referring to FIG. 13, shown is an example illustrating a main execution thread utilizing classes in an embodiment in accordance with techniques herein. The example 1400 illustrates a main execution thread which is code of the user interface (UI). The main execution thread of 1400 may include an instrument class or instrument base class 1402, and EPC utilities class 1404 and one or more instances of Automation Test classes (1406, 1408, 1410, 1412) and/or Automation Utility classes (1414, 1416). Each of the Automation Test classes (1406, 1408, 1410, 1412) and/or Automation Utility classes (1414, 1416) may reference the instrument base class 1402 and the EPC utilities class 1404. The main execution thread of 1400 may include or utilize other code not specifically illustrated in FIG. 13. For example, the main execution thread may include code for event driven controls in connection with processing and handling UI events such as menu displays and selections (not illustrated).

The 'EPCUtilities' class 1404 is defined in the WEAT base class as noted above. A single instance of the 'EPCUtilities' class is created for use at the UI (user interface) class level and passed by reference to any test class that may need to use the methods of the 'EPCUtilities' class. The EPCUtilities' class includes control and monitoring functions for the mass spectrometer using the embedded processing computer (EPC) in the mass spectrometer. For example, the EPCUtilities class may include a connect method which allows two IP connections to the EPC, the first being a telnet scripting connection (allowing scripted commands to be sent to the EPC using the Telnet protocol) and the second connection to a server module running on the EPC. The first connection may be used to send commands to drive instrument settings. The server component provides access to instrument readbacks and statuses.

Figure 14:
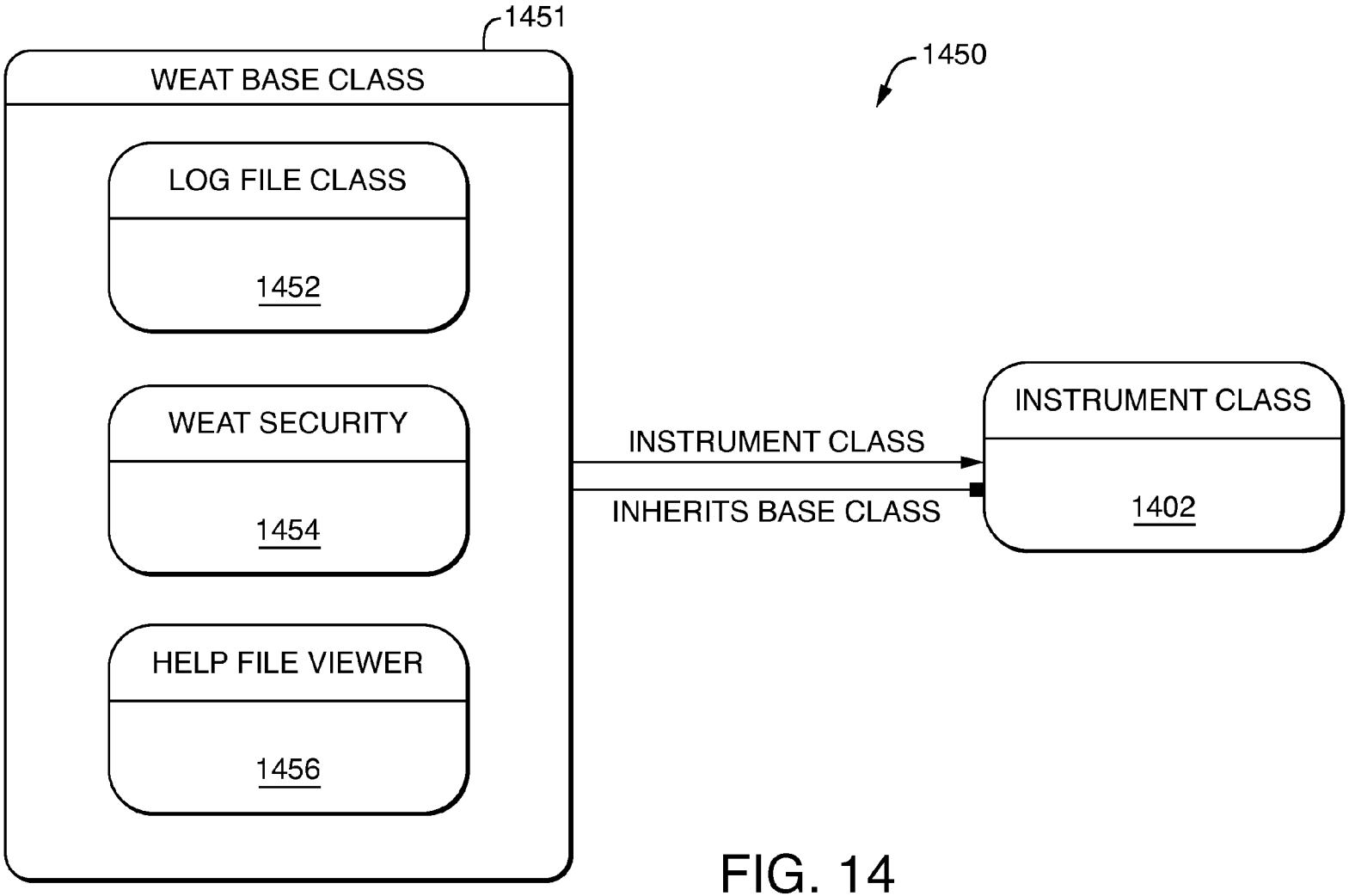

With reference to FIG. 14, the instrument base class 1402 is derived from the WEAT Base class 1451 as described above (e.g., in connection with Tables 1 and 2) which includes log file 1452, security 1454 and web browsing 1456 functions referenced by Automation Test class instances and Automation Utility class instances of the instrument class 1402.

Element 1452 may correspond to the LogFile class of Table 2 above. An instance of the log file class is created in the instrument level class library 1402 (which inherits the log file class from the WEATBaseClass) and this is passed by reference to individual tests to allow a log of test progress and results to be generated. The log file class 1452 may generate, for example, a formatted XML file containing results, comments and errors for all activity in the automated PM processing.

Element 1456 may correspond to the HelpFileViewer class of Table 2 above and including functionality for a form-based web browser. An instance of the browser class 1456 may be created in the instrument level class library 1402 (which inherits the browser class from the WEAT-BaseClass) and this is passed by reference to individual tests to allow the display of HTML or PDF help and diagnostic information. Functionality of the class 1456 may be used in connection with the UI, for example, to display help information.

Figure 15:
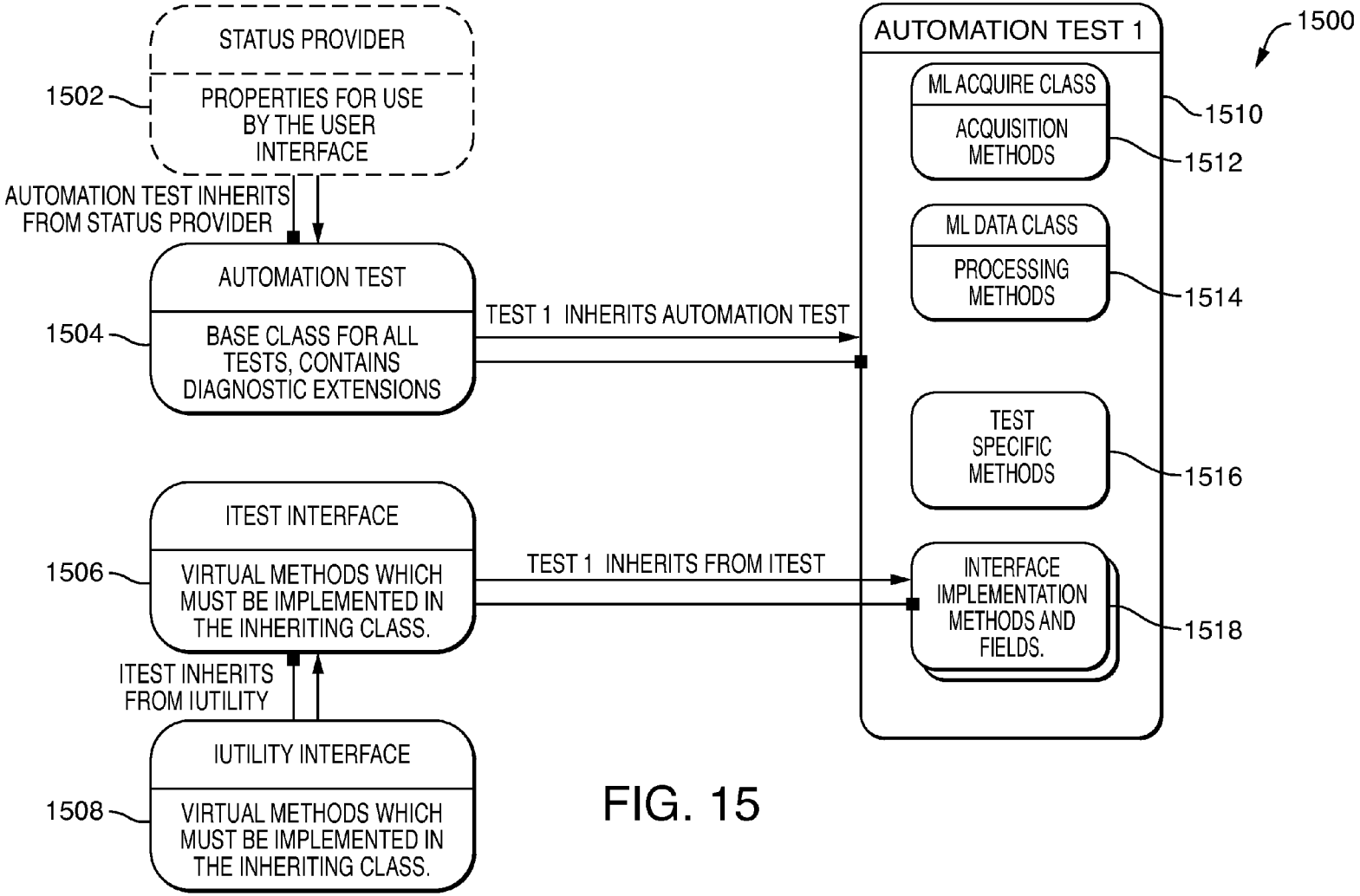

With reference to FIG. 15, shown is an example illustrating use of classes in connection with an Automation test instance, Automation test 1 1510, in an embodiment in accordance with techniques herein. Each individual test, such as 1510, is derived from the Automation Test Base Class 1504, which in turn inherits from the Status Provider Class 1502. The test 1510 may contain an instance of the MLAcquire Class 1512 and MLData Class 1514 along with methods, fields and properties (denoted 1516) specific to the test 1510. The test 1510 also implements methods 1518 of the inherited ITest interface 1506. The Itest Interface class 1506 and the IUtility Interface class 1508 describe interfaces of fields, properties and methods that are implemented as part of the test 1518. In other words, elements 1506, 1508 may define an interface for a method or data element which is implemented within the test 1510 and may be utilized by other code in connection with the user interface (e.g., to display test results, obtain test input data or selections, and the like). For example, methods having an interface as described by 1506, 1508 may be invoked in connection with implementation of the user interface for a particular automation test such as 1510. By each test implementing such defined interfaces as described by 1506, 1508, the user interface may perform uniform processing for all tests and such tests may be reusable with multiple application such as in connection with the PM automation application as well as others.

Figure 16:
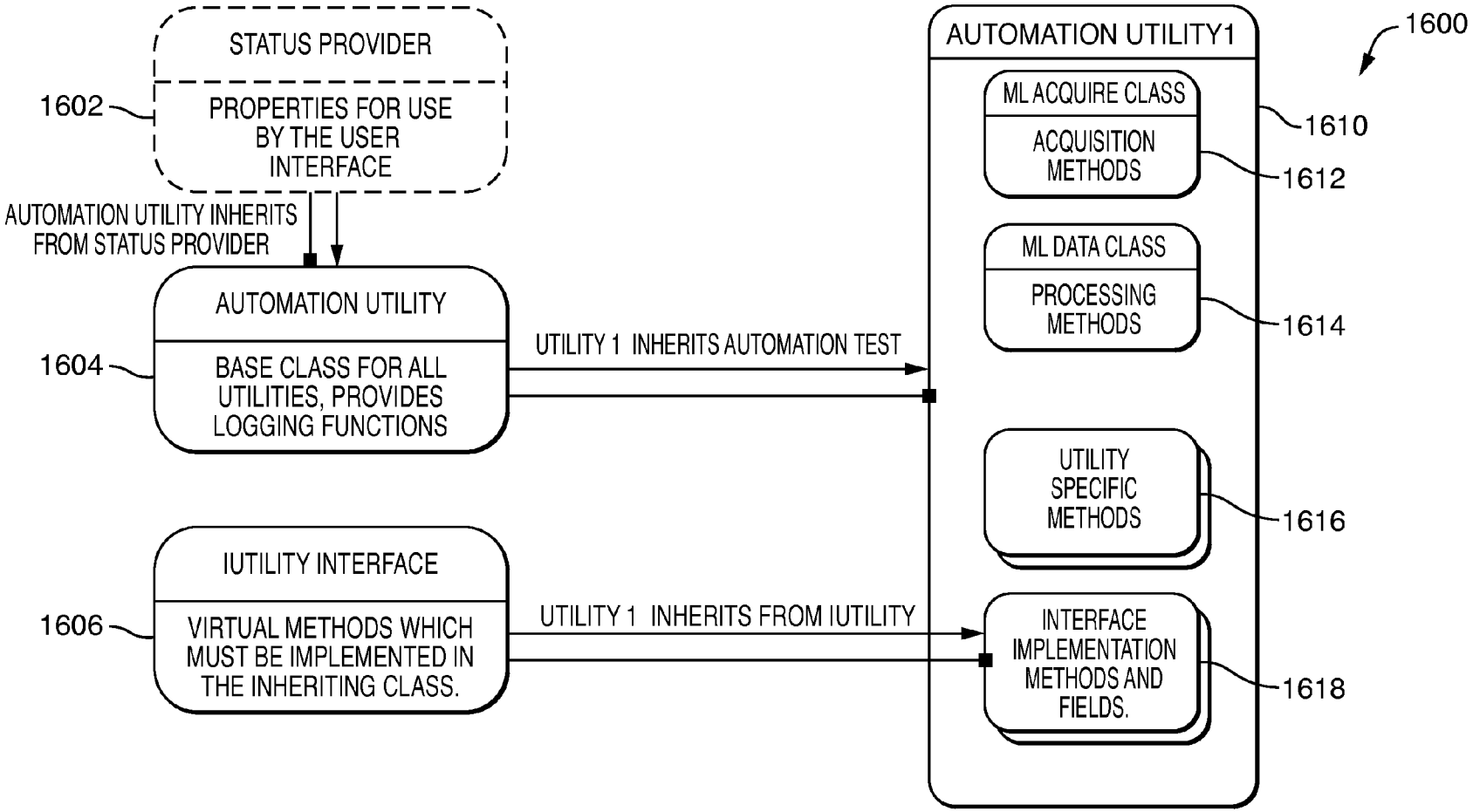

With reference to FIG. 16, shown is an example illustrating use of classes in connection with an Automation utility instance, Automation utility 1 1610, in an embodiment in accordance with techniques herein. Each individual utility, such as 1610, is derived from the Automation Utility Base Class 1604, which in turn inherits from the Status Provider Class 1602. The utility 1610 may contain an instance of the MLAcquire Class 1612 and MLData Class 1614 along with methods, fields and properties (denoted 1616) specific to the utility 1610. The utility 1610 also implements methods 1618 of the inherited IUtility interface 1606. The IUtility Interface class 1606 describes interfaces of fields, properties and methods that are implemented as part of the utility 1618. In other words, element 1606 may specify an interface for a method or data element which is implemented within the utility 1610 and may be utilized by other code in connection with the user interface. By each utility implementing such defined interfaces as described by 1606, the user interface may perform uniform processing for all utilities and such utilities may be reusable with multiple applications such as in connection with the PM automation application as well as others.

The 'StatusProvider' abstract class (denoted as 1502 of FIG. 15 and 1602 of FIG. 16) may be defined in the WEAT base class library as described above. The 'StatusProvider' abstract class may define a list of properties common to automation tests and utilities which define the state of a process at any time including display messages for the user, progress, error states and final outcome with access to results. The 'AutomationTest' class 1504 (class of automation tests) and 'AutomationUtility' class 1604 (class of automation utilities) inherit from the StatusProvider class. Any test or utility may have a final outcome of Pass, Fail or Warning, where Pass is successful completion of the test with a positive result, Fail is successful completion of the test with a negative outcome and warning is another alternative outcome. An automation test may be characterized as a test which returns a detailed result in addition to, or as an alternative to, one of the tri-state final outcome values of Pass, Fail and Warning, (for example a numerical value for a resolution measurement). An Automation test may also perform further diagnosis if a final outcome state is one other than Pass. An automation utility requires no such detailed results and does not require additional diagnosis as may be the case with an automation test. Based on the foregoing, the functionality of the AutomationTest class may be viewed as an expansion of functionality of the AutomationUtility class in accordance with the inheritance as illustrated in connection with FIG. 15. Each automation test, such as 1510, inherits from the AutomationTest class and each automation utility, such as 1610, inherits from the AutomationUtility class.

Figure 17:
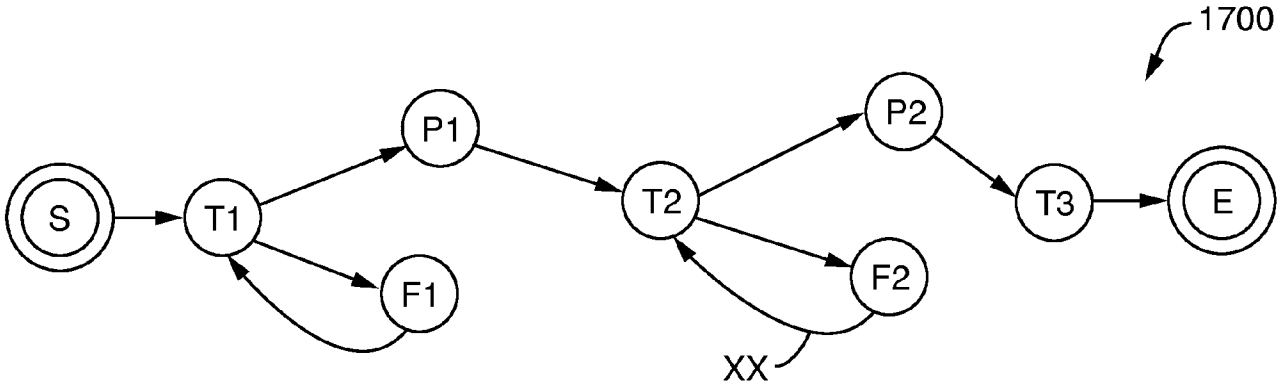
FIGS. 17-18 are illustrations of state transition diagrams used to represent exemplary test sequences and associated states for pre and post-maintenance testing in an embodiment in accordance with techniques herein.

Referring to FIG. 17, shown is an example illustrating a state transition diagram as may be associated with performing pre-maintenance testing (e.g., performance testing prior to performance maintenance) in an embodiment in accordance with techniques herein. The example 1700 provides a more general illustration of a simple testing sequence of three performance tests, T1, T2 and T3. Generally, performance tests of a testing sequence may be implemented using any of the automation tests and/or automation utilities as just described. If the performance test has a resulting state that is one of pass, fail, or warning, or is for information only, then such a performance test may be implemented using only automation utilities of the above-noted classes. In contrast, a performance test requiring additional diagnostics, and/or returning a result other than one of the foregoing tri-state values of pass, fail, or warning may be implemented using automation tests alone, or in combination with, automation utilities. Thus, the term "performance test" or test of a testing sequence (as used with pre and post-maintenance test) should be understood as a procedure that may be implemented using automation test instances and/or automation utility class instances depending on the particular performance test. Each of T1, T2 and T3 denotes such a performance test.

The example 1700 is a state transition diagram including a directed graph used to describe the testing sequence, states and transitions between such states. The graph of 1700 includes a series of nodes (denoted by circular elements) representing states and directed edges between the nodes representing state transitions. The node S represents the testing sequence start state and the node E represents a successful testing sequence end state. Nodes T1, T2, and T3 correspond to states of performing the different performance tests. Nodes F1 and F2 may represent failure test result states such as in connection with critical threshold test failures as described elsewhere herein. Nodes P1 and P2 represent all non-failure test result states (e.g., tests having outcomes of "pass", "warning"), respectively, for critical threshold tests T1 and T2. Test T3 may be for informational use only or may be a non-critical threshold test and therefore always transition successfully to state E. Tests T1 and T2 may be critical threshold tests such that, upon failure, pre-maintenance testing may resume or restart with the failing test and additionally require successfully reperforming all tests subsequent to the failing test in the sequence. This is consistent with the description above for critical threshold test failures as may occur in an embodiment in connection with pre-maintenance testing. It should be noted that implicit with each failed state F1, F2 for a critical threshold test is performing a corrective remedial action and then transitioning to one of the testing states T1, T2 to retest.

Figure 18:
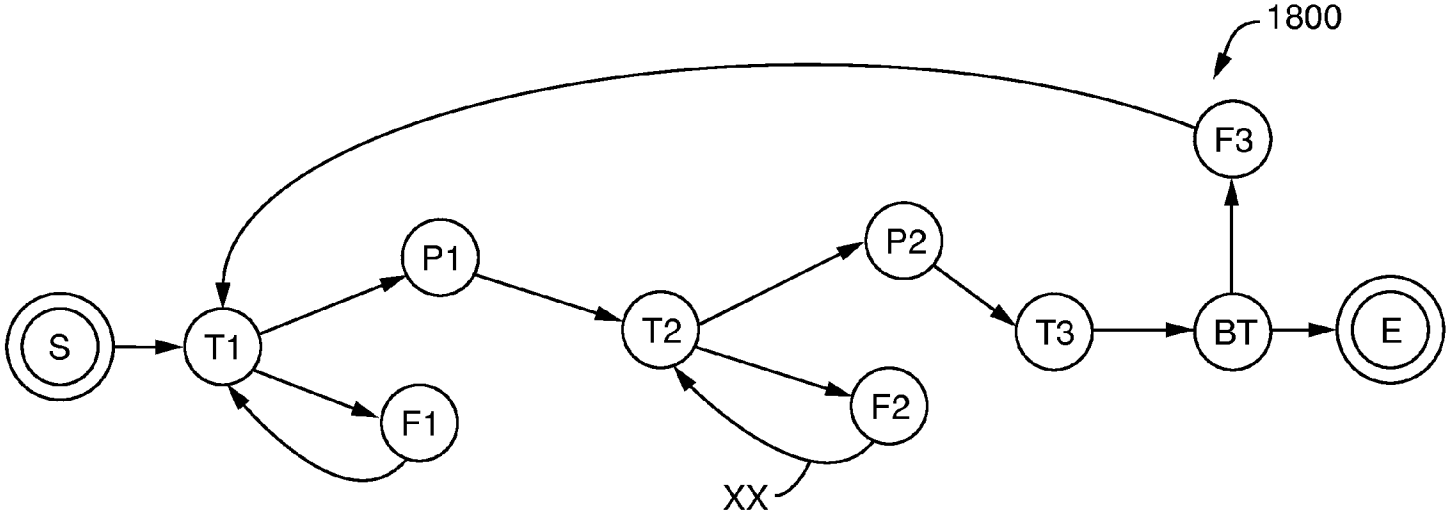

Referring to FIG. 18, shown is an example illustrating a state transition diagram as may be associated with performing post-maintenance testing (e.g., performance testing after performing a maintenance activity) in an embodiment in accordance with techniques herein. The example 1800 provides a general illustration of the simple testing sequence of the three performance tests, T1, T2 and T3 as described above in connection with FIG. 17. The example 1800 includes the same states and transition as described in connection with the example 1700 with the addition of the states BT and F3. State BT represents the additional benchmark comparison test state where the pre-maintenance and post-maintenance testing results are compared (e.g., step 1046 of FIG. 9). If the post-maintenance testing results are not the same or better than the pre-maintenance results (e.g., as in step 1048 of FIG. 9), the state of the post-maintenance testing sequence transitions from BT to F3. State F3 represents a failure state of the performance benchmark failure. From state F3, the testing sequence state transitions to T1 to restart the post-maintenance test sequence after performing a corrective or remedial action (e.g., step 1020 and 1018 of FIG. 9). As with FIG. 17, it should be noted that implicit with each failed state F1, F2, F3 is performing a corrective remedial action and then transitioning to one of the testing states T1, T2 for retesting.

As a variation to the foregoing upon occurrence of entering state F3, rather than return to T1 and reperform all post-maintenance tests, an embodiment may transition back to the test state corresponding to the first failed benchmark comparison test of the sequence and then reperform all tests including the failed test and those subsequent to the failed test in the sequence. For example, if only test T2 post-maintenance results indicated a degradation in performance with respect to T2 pre-maintenance results, state F3 may transition to T2 after a corrective action to perform retesting in connection with T2, T3 and BT or benchmark comparison testing for T2 and T3.

Use of the techniques herein for automated PM processing may provide benefits over PM processing including manual testing. Generally, the time required to perform the test and collect and analyze test data may be reduced. Since the testing process is automated with tests performed in a prescribed enforced ordering and analysis such as comparison are automated, human aspects related to the foregoing are removed thereby providing a level of consistency of process and accuracy of results, from instrument to instrument. Additionally, a required level of knowledge or skill required to perform tests may be reduced due to the automation. Depending on the particular tests performed, pre-maintenance testing may be performed without the need for an instrument-specific qualified engineer on site enabling further gains in process efficiency by identification of remedial work, extra maintenance work and parts required, etc., prior to an on-site visit by the engineer. For example, the tests such as those comprising the pre-maintenance testing sequence may be initiated remotely from a technical support center at a different physical location from the MS system under test. The foregoing may be performed, for example, when the support center is working with a less-experienced individual onsite where the MS system is located.

The techniques herein may be performed by executing code which is stored on any one or more different forms of computer-readable media. Computer-readable media may include different forms of volatile (e.g., RAM) and non-volatile (e.g., ROM, flash memory, magnetic or optical disks, or tape) storage which may be removable or non-removable.

Variations, modifications, and other implementations of what is described herein will occur to those of ordinary skill in the art without departing from the spirit and the scope of the invention as claimed. Accordingly, the invention is to be defined not by the preceding illustrative description but instead by the spirit and scope of the following claims.

What is claimed is:

1. A method of performing performance maintenance on a mass spectrometer, the method comprising:

displaying a user interface that controls a performance maintenance process for completing the performance maintenance of the mass spectrometer, the performance maintenance process including a predefined order of processing steps, wherein, at a current point in the performance maintenance process, different user interface options performing associated processing steps of the performance maintenance process are disabled to enforce performing processing steps of the performance maintenance process in the predefined order;

performing pre-maintenance testing, wherein said pre-maintenance testing includes automating execution of a test sequence in response to a first user interface selection of a first option of the user interface controlling the performance maintenance process;

performing a maintenance activity upon completion of said pre-maintenance testing;

performing post-maintenance testing upon completion of said maintenance activity, wherein said post-maintenance testing includes automating execution of the test sequence in response to a second user interface selection of a second option of the user interface controlling the performance maintenance process, and wherein, when performing said post-maintenance testing, said second option is enabled and said first option is disabled in accordance with enforcing the predefined order; and performing a benchmark comparison to determine whether performance of the mass spectrometer has degraded as a result of performing the maintenance activity, wherein said benchmark comparison is performed automatically in response to completing said post-maintenance testing.

2. The method of claim 1, wherein said performing a benchmark comparison includes comparing pre-maintenance testing data and results to post-maintenance testing data and results.

3. The method of claim 1, wherein the test sequence specifies a predetermined order in which a plurality of tests are performed for the pre-maintenance testing and for the post-maintenance testing.

4. The method of claim 1, wherein the mass spectrometer includes one or more heaters which are tested in a first test of the test sequence, said first test being a critical threshold test and wherein, responsive to a failure of the critical threshold test, the test sequence terminates, a remedial action in accordance with the failed critical threshold test is performed, and execution of the test sequence resumes with reperforming the failed critical threshold test.

5. The method of claim 1, wherein the test sequence includes a first test performing an intensity test including determining whether one or more detected chromatographic peaks have at least a minimum intensity, said first test being a critical threshold test and wherein, responsive to a failure of the first test, the test sequence terminates, a remedial action in accordance with the first test is performed, and execution of the test sequence resumes with reperforming the first test.

6. The method of claim 1, wherein, an electronic checklist is displayed which lists a plurality of items completed in connection with performing the maintenance activity and, responsive to user interface selections indicating completion of the plurality of items, the first option of the user interface selected in connection with the first user interface selection is disabled and the second option of the user interface selected in connection with the second user interface selection is enabled.

7. The method of claim 1, wherein, responsive to the benchmark comparison determining that performance of the mass spectrometer has degraded as a result of performing the maintenance activity, said post-maintenance testing is re-performed a subsequent time and the benchmark comparison is re-performed using first test data and results from the pre-maintenance testing and second test data and results from re-performing the post-maintenance testing.

8. The method of claim 1, further comprising saving performance maintenance status information characterizing a current state of performance maintenance processing, said status information enabling resuming execution of performance maintenance processing at a subsequent point in time, said performance maintenance processing including said steps of performing pre-maintenance testing, performing a maintenance activity, performing post-maintenance testing, and performing a benchmark comparison.

9. The method of claim 1, further comprising determining an overall status of the performance maintenance, said determining the overall status including:

performing said benchmark comparison and determining a first status indicating whether performance of the mass spectrometer has degraded as a result of performing the maintenance activity, said first status being success if the performance has not degraded;

obtaining a testing outcome of pass or fail from each of one or more other tests; and performing a logical AND operation of the first status and the testing outcome for each of the one or more other tests thereby determining said overall status is success only if the first status indicates success and the testing outcome for each of the one or more other tests indicates success, otherwise said overall status is failure.

10. The method of claim 9, wherein said one or more other tests include a first non-critical threshold test performed as part of both said pre-maintenance testing and said post-maintenance testing and a second test performed in said post-maintenance testing and not in said pre-maintenance testing.

11. The method of claim 10, wherein said performing said benchmark comparison includes comparing first performance results for the first non-critical threshold test executed in said pre-maintenance testing with second performance results for the first non-critical threshold test executed in said post-maintenance testing.

12. The method of claim 11, wherein said performing said benchmark comparison includes comparing a first value for a metric included in the first performance results to a second value for the metric in the second performance results.

13. The method of claim 1, wherein the test sequence includes a non-critical threshold test and a critical threshold test, and wherein, responsive to failure of the critical threshold test, first processing is performed that includes:

terminating the test sequence;

performing a remedial action in accordance with the failed critical threshold test; and resuming execution of the test sequence including reperforming the failed critical threshold test, and wherein, responsive to failure of the non-critical threshold test, second processing is performed that includes:

performing one or more tests of the test sequence subsequent to the failing non-critical threshold test thereby not terminating the test sequence.

14. The method of claim 13, wherein the test sequence includes an informational test.

15. The method of claim 14, wherein a first test that is included in the test sequence and is subsequent to the critical threshold test in the test sequence generates first test results, said first test being dependent upon test results of the critical threshold test.

16. The method of claim 15, wherein validity of the first test results depends on having a successful test result of the critical threshold test.

17. A computer readable medium comprising executable code stored thereon that, when executed, performs a method of performance maintenance on a mass spectrometer comprising:

displaying a user interface that controls a performance maintenance process for completing the performance maintenance of the mass spectrometer, the performance maintenance process including a predefined order of processing steps, wherein, at a current point in the performance maintenance process, different user interface options performing associated processing steps of the performance maintenance process are disabled to enforce performing processing steps of the performance maintenance process in the predefined order;

performing pre-maintenance testing, wherein said pre-maintenance testing includes automating execution of a test sequence in response to a first user interface selection of a first option of the user interface controlling the performance maintenance process;

performing a maintenance activity upon completion of said pre-maintenance testing;

performing post-maintenance testing upon completion of said maintenance activity, wherein said post-maintenance testing includes automating execution of the test sequence in response to a second user interface selection of a second option of the user interface controlling the performance maintenance process, and wherein, when performing said post-maintenance testing, said second option is enabled and said first option is disabled in accordance with enforcing the predefined order; and performing a benchmark comparison to determine whether performance of the mass spectrometer has degraded as a result of performing the maintenance activity, wherein said benchmark comparison is performed automatically in response to completing said post-maintenance testing.

18. The computer readable medium of claim 17, wherein the test sequence includes a non-critical threshold test and a critical threshold test, and wherein, responsive to failure of the critical threshold test, first processing is performed that includes:

terminating the test sequence;

performing a remedial action in accordance with the failed critical threshold test; and resuming execution of the test sequence including reperforming the failed critical threshold test, and wherein, responsive to failure of the non-critical threshold test, second processing is performed that includes:

performing one or more tests of the test sequence subsequent to the failing non-critical threshold test thereby not terminating the test sequence.

19. The computer readable medium of claim 18, wherein said performing a benchmark comparison includes comparing pre-maintenance testing data and results to post-maintenance testing data and results.

20. The computer readable medium of claim 18, wherein the test sequence includes an informational test.

* * * * *